US006411864B1

(12) United States Patent
Fromherz et al.

(10) Patent No.: US 6,411,864 B1
(45) Date of Patent: Jun. 25, 2002

(54) APPARATUS AND METHOD OF DISTRIBUTED OBJECT HANDLING

(75) Inventors: Markus P. J. Fromherz, Palo Alto, CA (US); Sudhendu Rai, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/460,387

(22) Filed: Dec. 13, 1999

(51) Int. Cl.[7] ..... G06F 7/00

(52) U.S. Cl. ..... 700/228; 700/213; 700/225; 701/301

(58) Field of Search ..... 700/213, 228, 700/255; 701/301, 200, 201, 202; 198/341.05, 502.3

(56) References Cited

U.S. PATENT DOCUMENTS

| | | | | | |
|---|---|---|---|---|---|
| 5,283,739 | A | * | 2/1994 | Summerville et al. | 364/424.02 |
| 5,519,618 | A | * | 5/1996 | Kastner et al. | 364/439 |
| 5,999,758 | A | | 12/1999 | Rai et al. | |
| 6,002,890 | A | | 12/1999 | Jackson et al. | |
| 6,161,058 | A | * | 12/2000 | Nishijo et al. | 700/218 |
| 6,278,907 | B1 | * | 8/2001 | Fromherz | 700/255 |
| 6,308,110 | B1 | * | 10/2001 | Fromherz | 700/228 |

* cited by examiner

*Primary Examiner*—Christopher P. Ellis
*Assistant Examiner*—Khoi H. Tran
(74) *Attorney, Agent, or Firm*—Oliff & Berridge, PLC

(57) ABSTRACT

A modular object handling system has a multi-level control architecture, which includes a system controller that coordinates the functions and/or operations of individual module controllers, that in turn control corresponding actuators, to provide a desired system function. The system controller performs the overall trajectory planning by taking the constraints of each of the module actuators into account. The system controller may compensate for deviations of objects from their planned trajectories by contemporaneously redetermining trajectories and trajectory envelopes to encode the various combinations of the system constraints and task requirements. The trajectory envelopes can denote regions around other trajectories to indicate control criteria of interest, such as control and collision boundaries. However, by predetermining the trajectories and trajectory envelopes, and comparing the current state of an object with the predetermined trajectory envelopes, the system controller can even more quickly determine the extent to which the state satisfies the criteria. Thus, this system simplifies on-line determinations to merely include a comparison between a particular object, a particular trajectory and the corresponding trajectory envelope. It is also desirable to predetermine multiple trajectories, as well as trajectory envelopes associated with each of the multiple trajectories, for each object. The apparatus and methods of the invention can then monitor the status of each object, and switch between the multiple predetermined trajectories in order to actively improve energy usage efficiency. The apparatus and methods can also modify the trajectories of other objects to avoid collisions with the object whose trajectory was originally switched. Other exemplary embodiments of the invention include determining the multiple trajectories, as well as the trajectory envelopes associated with each of the multiple trajectories, by taking various requirements of the trajectory envelopes into account.

30 Claims, 16 Drawing Sheets

FIG. 1
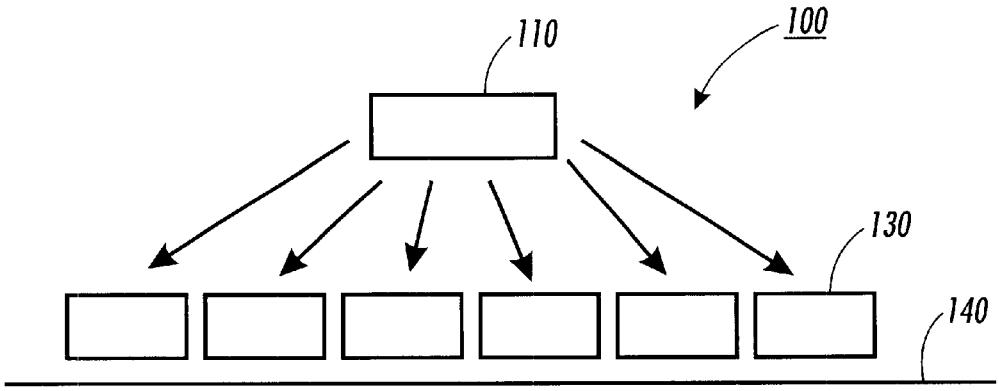
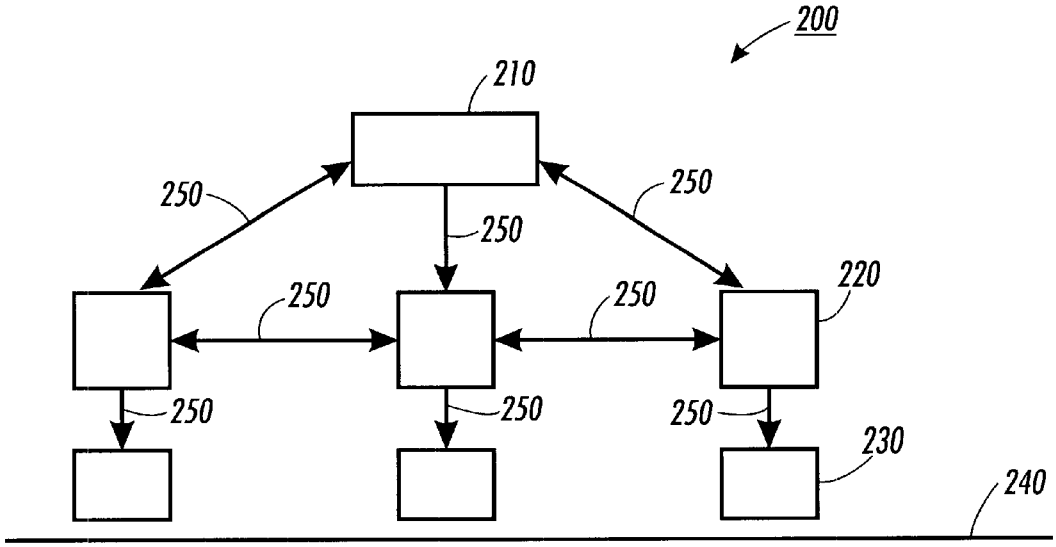
FIG. 2

FIG. 3
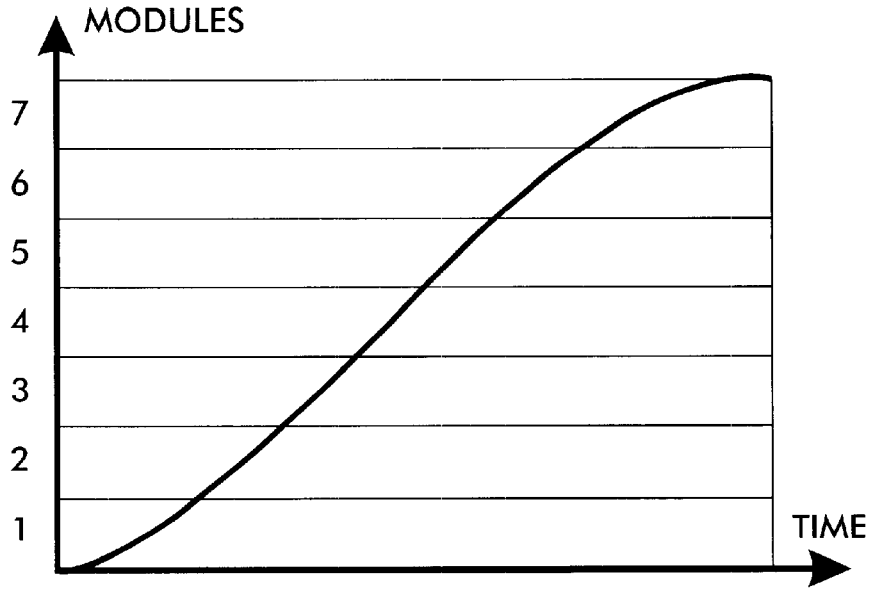
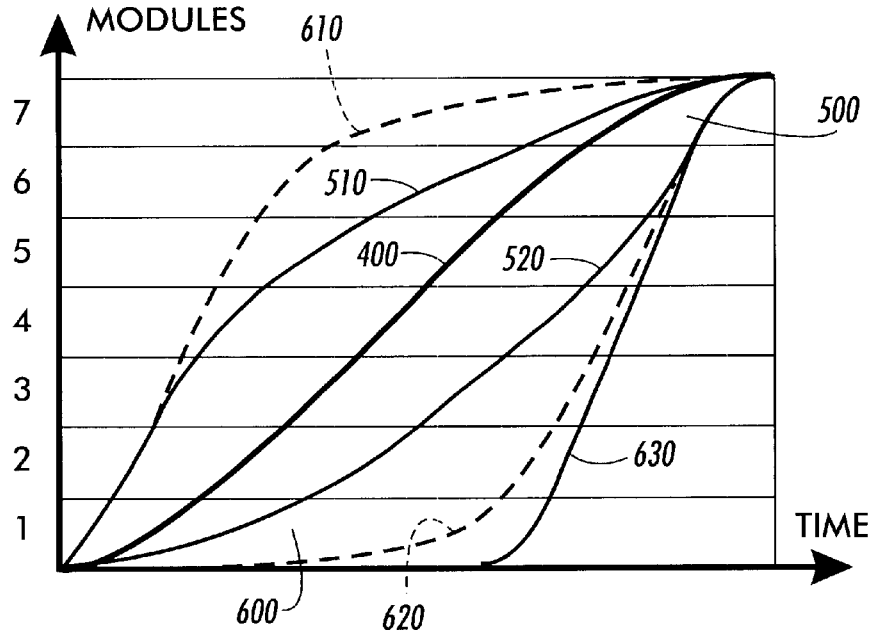
FIG. 4

APPARATUS AND METHOD OF DISTRIBUTED OBJECT HANDLING

BACKGROUND OF THE INVENTION

1. Field of Invention

This invention is directed to apparatus and methods of distributed object handling.

2. Description of Related Art

A traditional media handling system can move media, such as a sheet, from one location to another location along a path, while performing one or more operations on the sheet, such as inversion, image transfer or fusing. As shown in FIG. 1, a traditional media handling system 100 includes a controller 110 that controls multiple actuators 130, which perform operations on the sheet while moving the sheet along a paper path 140.

Typically, timing signals are used to coordinate the operations and sheet movement. For example, the sheet can be fed into the path 140 at a certain time according to a timing signal. The sheet can then move through the path 140, past various position sensors within a certain time window, and arrive at a transfer station at a specific time.

SUMMARY OF THE INVENTION

However, this traditional media handling system 100 is subject to the problem that when any temporal error in the operations beyond a certain tolerance is detected and flagged to the controller 110, the machine containing the traditional media handling system 100 is shut down. The traditional media handling system 100 does not include any feedback control. Thus, the actuators 130 need to be precisely manufactured, which is expensive. Also, because of this lack of feedback control, the traditional media handling system 100 does not perform well when subjected to different types of media, and has problems maintaining accuracy and reliability at high speeds.

A modular object handling system can overcome these problems via a more control-centric design, which can be accomplished by adding more controls. The use of control strategies, beyond the simple timing of the traditional media handling system 100, can also allow a wider range of objects, such as a wider range of media types, to be handled at higher speeds.

For example, a modular object handling system that includes a multi-level control architecture can provide advantages over the traditional media handling system 100 discussed above. This modular object handling system can include a system controller that coordinates the functions and/or the operations of individual module controllers, which in turn control corresponding actuators, to provide a desired system function, such as transporting objects along a path. In particular, the system controller can download an overall trajectory for each object to the module controllers. The module controllers can control their respective actuators to maintain each object on its planned trajectory while in that module.

The system controller performs the overall trajectory planning by taking the constraints of each of the module actuators into account. The trajectories planned by the system controller can then be provided as functions in distance-time space, such as cubic splines.

Deviations from an object's desired trajectory typically occur during the operation of the modular object handling system. For minor deviations, all control can be left to the individual module controllers, since they may not be concerned with other module controllers or whether the overall control criteria are satisfied. However, the system controller is concerned with satisfying the overall control criteria. Thus, the system controller may constantly monitor the location of the objects and contemporaneously redetermine the objects' trajectories using various control techniques to make up for such deviations.

However, continuously replanning trajectories by accessing complex trajectory redetermining techniques can be difficult to accomplish in real time. In fact, depending on the equipment and software involved, it may be necessary to resort to approximate determinations and heuristics to identify the effects of deviations and to replan the deviating trajectories in real time.

Thus, instead of continuously replanning the deviating trajectories, it may be desirable to use predetermined trajectories and trajectory envelopes to encode the various combinations of system constraints and task requirements. The trajectory envelopes can denote regions around other trajectories to indicate control criteria of interest, such as control and collision boundaries. By comparing the current state of an object with the predetermined trajectory envelopes, the system controller can quickly determine the extent to which the current state satisfies the control criteria.

For example, instead of continuously checking the distance between objects and redetermining the trajectories to avoid collisions, a predetermined collision envelope around the desired trajectory can be used. The predetermined collision envelopes are determined such that, as long as the objects are within their collision envelopes, the objects will not collide. A control envelope can similarly be used to determine other control criteria, such as whether the object will reach its target on time to accomplish a task requirement. This modular object handling system simplifies on-line determinations to merely include a comparison between a particular trajectory and the corresponding trajectory envelope, or between a current object position and a trajectory envelope.

The systems and methods discussed above predetermine a trajectory, as well as well as at least one predetermined trajectory envelope that is associated with the trajectory, for each object moving along the path. However, if the predetermined trajectory envelope is large and/or an the object deviates a large amount from the predetermined trajectory, then an unnecessarily large amount of energy may be exerted in attempting to place that object back on that object's predetermined trajectory.

To avoid this, multiple trajectories, as well as trajectory envelopes associated with each of the multiple trajectories, can be determined for each object. The apparatus and methods of the invention can then monitor the status of each object, and switch between the multiple predetermined trajectories in order to actively improve energy usage efficiently. The apparatus and methods can also modify the trajectories of other objects to avoid collisions with the object whose trajectory was originally switched.

Other exemplary embodiments of the invention include determining the multiple trajectories, as well as the trajectory envelopes associated with each of the multiple trajectories. This determination can take various requirements of a trajectory envelope into account, such as ensuring that all relevant constraints remain satisfied as long as an object remains within the trajectory envelope, ensuring that the trajectory envelope is large enough so that the object will not leave the trajectory envelope under normal circumstances, ensuring that the earliest trajectory envelope corresponds to the earliest possible trajectory of an object, and ensuring that the latest trajectory envelope corresponds to the latest possible trajectory of an object.

A method of determining trajectories and trajectory envelopes, while also taking the trajectory envelope requirements discussed above into account, can include specifying a system model as well as system constraints and task requirements. A first nominal trajectory can be determined. Earlier nominal trajectories can then be determined, starting from the first nominal trajectory, by applying a safe object distance constraint backward, applying an expected error/deviation model, and/or solving a suitable subset of the constraints while optimizing for the earliest possible new trajectory. Later nominal trajectories can also be determined, starting at the first nominal trajectory, by applying a safe object distance constraint forward, applying an expected error/deviation model, and/or solving a suitable subset of the constraints while optimizing for the latest possible new trajectory. An envelope can also be determined for each of the determined nominal trajectories.

These and other features and advantages of this invention are described in or are apparent from the following detailed description of various exemplary embodiments of the systems and methods according to this invention.

BRIEF DESCRIPTION OF THE DRAWINGS

Various exemplary embodiments of systems and methods according to this invention will be described in detail, with reference to the following figures, wherein:

FIG. 1 is a block diagram of a traditional media handling system;

FIG. 2 is a block diagram of a modular object handling system in accordance with the invention;

FIG. 3 is a graph that shows a typical time-distance nominal trajectory;

FIG. 4 is a graph showing trajectories and trajectory envelopes for sample system and task constraints;

DETAILED DESCRIPTION OF PREFERRED EMBODIMENTS

Figure 5:
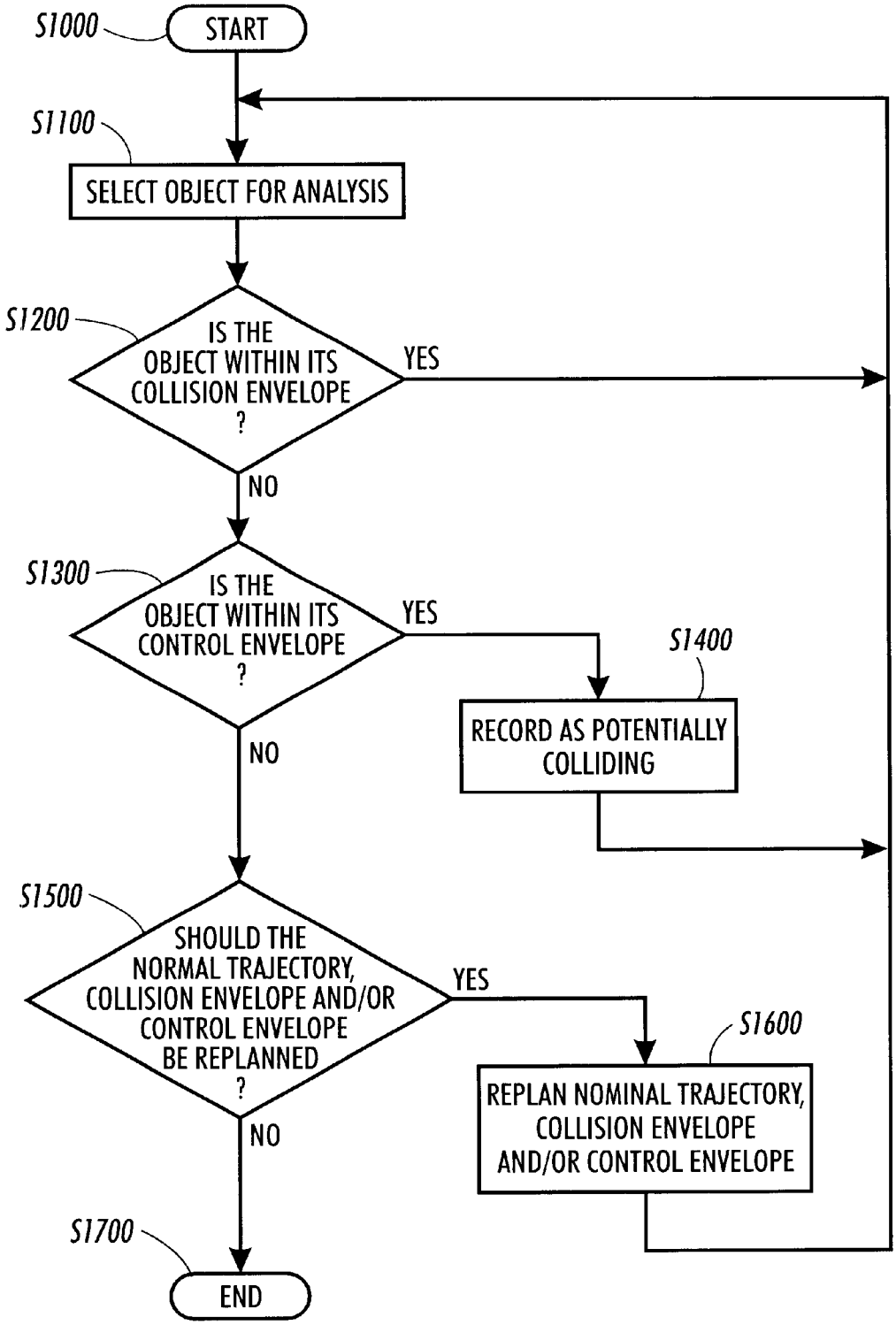
FIG. 5 is a flowchart outlining one exemplary embodiment of a method for using predetermined trajectories and trajectory envelopes in system level control of a multi-level modular object handling system.

FIG. 2 shows a modular object handling system 200 according to this invention that has a more control-centric design than the traditional media handling system 100. This modular object handling system 200 includes a system controller 210, one or more module controllers 220, one or more module actuators 230, and a path 240. The system controller 210 communicates with the module controllers 220 via communication links 250 to coordinate the functions and/or operations of the individual module actuators 230 to provide a desired system function, such as transporting multiple objects along the path 240 via the module actuators 230. The system controller 210 plans a trajectory of each object along the path 240, by taking into account a variety of system constraints and task requirements. The module controllers 220 control their respective module actuators 230 via communication links 250 to maintain each object on its planned trajectory. This control strategy can be referred to as multi-layered hierarchical control architecture.

In order to plan a trajectory while taking a variety of system constraints and requirements into account, it is helpful for the system controller 210 to be aware of certain data relating to the module controllers 220 and the module actuators 230. For example, the system controller 210 can be aware of entrance and exit points of each of the module actuators 230, a maximum accelerating and retarding force that can be applied to an object by each module actuator 230, and/or a response time of each module controller 220.

The system controller 210 downloads the planned trajectories for each object to the local module controllers 220 via the communication links 250. In one exemplary embodiment, the system controller 210 can download time-optimal trajectories to move objects at high speeds in the shortest possible time from one point to another point along the path 240 to enhance the productivity of the modular object handling system 200.

In the trajectories for the path 240, the object moves along the path 240 through regions where the object is subject to the control of several module actuators 230, the time-optimal trajectories can be implemented by each module actuator 230 either applying maximum actuation or minimum actuation with discrete switching between the two. This can be proven by considering an arbitrary modular object handling system 200 that includes n module actuators 230. Each module actuator 230 can apply a maximum acceleration a on the object using an array $A=[a_1, \ldots a_n]$, where $a_n$ is the maximum acceleration of the nth module actuator 230. The n module actuators 230 can also apply a maximum retardation r on the object using an array $R=[r_1, \ldots r_n]$, where $r_n$ is the maximum retardation of the nth module actuator 230. The object enters the path 240 at some velocity $v_0$ and leaves the path 240 at some velocity $v_n$.

Then, a desired trajectory, assuming that there are no other constraints, can be determined by first forward integrating the equations of motion of the object using the maximum accelerations for each module actuator, given the initial position and the initial velocity $v_0$. Then, the equations of motion of the object are backward integrated using the maximum retardations for each module actuator given the desired final position and velocity $V_n$. Next, the intersection points of the two trajectories, i.e., the switching times, are determined. In other words, the object moves forward under maximum acceleration from each module actuator 230 until the switching time, and then is retarded at maximum retardation by each module actuator 230 until that object reaches the final position and velocity.

As discussed above, the system controller 210 provides each module controller 220 with the trajectory for each object, which is usable by the module controller 220 to move the object once the object enters a region where the object is subject to control by the corresponding module actuator 230. Communicating the distance-time trajectory via the communication links 250 to each module controller 220 can be done by supplying a sequence of points on the trajectory. However, such a representation requires significant communication bandwidth, especially if the trajectory information has to be downloaded to all the module controllers 230 via the communication links 250, which may be several in number.

Since trajectories are communicated to several module controllers 220 via the communication links 250 in real time, it is desirable to provide a compact and efficient representation of the trajectories that do not overload the communication links 250 and that are computationally efficient. For example, the trajectories can be conceived as functions in a distance-time space. In fact, these functions can be represented as expansions of general basis functions. Basis functions can be computationally efficient, and once known, the trajectories can be reconstructed. An example of such basis functions can be polynomials, such as, for example, polynomial spline basis functions. Such a representation significantly reduces the amount of floating point numbers that the system controller 210 needs to send down to the local control modules 220. Accordingly, high speed control is enabled without bogging down networks of the communication links 250.

For example, the trajectories can be represented as cubic splines, wherein y(t) is position, v(t) is velocity and a(t) is acceleration of the object on the trajectory. The position, velocity and acceleration of the object on the trajectory can be represented as follows:

$$y(t)=a_0+a_1(t-t_0)+a_2(t-t_0)^2+a_3(t-t_0)^3;$$

$$v(t)=a_1+2a_2(t-t_0)+3a_3(t-t_0)^2;$$

and $$a(t)=2a_2+6a_3(t-t_0).$$

Where:

$a_0$, $a_1$, $a_2$ and $a_3$ are constants;

$t_0 \leqq t \leqq t_1$; and t is a specified time.

Each of these splines can be represented as a curve on the Cartesian plane from time $t_0$ to time $t_1$, wherein either the position y, the velocity v, or the acceleration a is represented on one axis, and the time t is represented on the other axis. The shape of each of the curves is determined by the constants $a_0$, $a_1$, $a_2$ and $a_3$.

Thus, once the constants $a_0$, $a_1$, $a_2$ and $a_3$ are known, any position y(t) can be evaluated along the curve defined by the above cubic spline. The spline v(t) representing the velocity of the object on the trajectory can then be provided by taking the derivative of the position y(t). Similarly, the spline a(t) representing the acceleration of the object on the trajectory can be provided by taking the derivative of the velocity v(t).

By selecting the initial time $t_0$ and the final time $t_1$, each of the constants become:

$$a_0=y_0;$$

$$a_1=v_0;$$

$$a_2=\frac{\frac{3(y_1-y_0)}{t_1-t_0}-2v_0-v_1}{t_1-t_0}; \text{ and}$$

$$a_3=\frac{v_0+v_1+\frac{2(y_0-y_1)}{t_1-t_0}}{(t_1-t_0)^2}.$$

Where:

$y_0$ and $y_1$ are the positions of the object on the trajectory at times $t_0$ and $t_1$, respectively; and $v_0$ and $v_1$ are the velocities of the object on the trajectory at times $t_0$ and $t_1$, respectively.

The above representation of the constants $a_2$ and $a_3$ can be further simplified by representing the change in position between times $t_1$ and $t_0$, i.e., $y_1-y_0$, as l, and the total lapsed time between times $t_1$ and $t_0$, i.e., $t_1-t_0$, as d. The constants $a_2$ and $a_3$ thus become:

$$a_2=\frac{3l/d-2v_0-v_1}{d}; \text{ and}$$

$$a_3=\frac{v_0+v_1-2l/d}{d^2}.$$

The modular object handling system 200 can include a number of the module actuators 230. In this modular object handling system 200, the time that the object enters the first module actuator 230 is $t_{1-1}$ or $t_0$. The time that the object exits the last, i.e., $n^{th}$, module actuator 230, is $t_n$. Thus, the duration of the object in the modular object handling system 200 is $t_n-t_0$. The time that an object enters the $j^{th}$ module actuator 230 is $t_{j-1}$, and the time that the object exits the $j^{th}$ actuator 230 is $t_j$. Thus, the time that the object is within the $j^{th}$ module actuator 230 is $t_j-t_{j-1}$.

For the interval $t_j-t_{j-1}$, which represents the time that the object is in the $j^{th}$ module actuator 230, the constants $a_0$, $a_1$, $a_2$ and $a_3$ can be determined so that the above-described splines represent the overall system trajectory, i.e., the trajectory of the object within the entire modular object handling system 200. However, if the overall system trajectory must be changed within the $j^{th}$ module actuator 230, then new constants $a_0$, $a_1$, $a_2$ and $a_3$ must be determined. The new trajectory will begin at $t_{j-1}$, and will be continuous and have continuous first derivatives with the old trajectory.

When the modular object handling system 200 is operating, multiple objects can move through the path along trajectories, which may be determined and represented as discussed above. Under these circumstances, one of the functions of the system controller 210 can be to apprehend situations where objects might collide and to avoid such collisions. The system controller 210 can detect collisions based on the relative position and velocities of the objects in the path 240.

In one exemplary embodiment of a method for detecting and avoiding collisions according to this invention, the system controller 210 keeps track of the objects as the objects move. If the objects become too close to each other, and at the same time have non-zero relative velocities, the system controller 210 can redefine the trajectories of the objects to ensure that the objects do not collide. If the maximum acceleration that the objects can be moved at by the module actuators 230 is bounded, and the acceleration is a(t), then $a(t)\epsilon[-a_{max}, a_{max}]$. The maximum relative acceleration is therefore:

$$a_{coll\text{-}avoid}=2a_{max}.$$

In accordance with this exemplary embodiment of the collision avoidance method, the system controller 210 continuously monitors the relative object spacing and relative object velocity for all objects and continuously updates the trajectory envelopes as outlined above. Whenever the system controller 210 determines that an object has moved too close to another object, the system controller 210 forces the local module controllers 220 to decrease the relative velocity of the appropriate objects by slowing down the trailing object. This is accomplished by changing the position-time reference trajectory via increasing the arrival time at the end of the appropriate module actuator 230. Thus, the objects are always kept in a safe region of the modular object handling system 200 by the system controller 210. If, despite repeated corrections, the objects still tend to move too close together, the system controller 210 brings all the objects to a graceful halt by gradually slowing down all of the objects.

As discussed above, the modular object handling system 200 shown in FIG. 2 tracks the objects using feedback control using the techniques outlined above. The local module controllers 220 accept the trajectories provided by the system controller 210 and control their respective module actuators 230 to keep the objects on the desired trajectories. The local module controllers 220 can also communicate with the system controller 210 and other local module controllers 220, if necessary, to keep the objects on their appropriate trajectories.

The module actuators 230 can perform various tasks. Each task has a corresponding description in the appropriate space-time. The overall system trajectory planning is performed by keeping the constraints imposed by the task of each of the module actuators 230. For example, the dwell time of an object that is stationary within a module actuator 230 corresponds to a horizontal line in the distance-time trajectory. When an object is simultaneously in two module actuators 230, this situation can be described as a trajectory that has the same slope, i.e., velocity, in the distance region specified for both module actuators 230. The trajectory therefore operates to effectively encode the constraints involved in moving the object on the path 240.

The communication links 250 shown in FIG. 2 are used to communicate the trajectory information back and forth between the module controllers 220, the system controller 210 and/or any other intermediate controller (not shown) in the modular object handling system 200. This bi-directional flow of information allows real-time corrections to be made to the trajectories. This ensures that conflicts between the multiple objects in the path 240 are resolved. For example, if two objects begin to get too close, that situation is sensed and the trajectories are replanned appropriately either by the module controllers 220 themselves or by the system controller 210. The new trajectories are then communicated to the appropriate module actuators 230. The module actuators 230 in turn, change their actuation to track the new trajectory.

The modular object handling system 200 discussed above provides numerous advantages over the traditional, single controller, object handling systems 100. For example, using active feedback control to track trajectories allows different types of objects to be handled. The control techniques discussed above can have parameters that depend on the object properties, and can be adjusted in real time depending on the object types. This can be accomplished by inputting the object properties to the modular object handling system 200. This can alternatively be accomplished by the modular object handling system 200 selecting the object properties during operation.

For high productivity, it is desirable to move objects at higher speeds. The modular object handling system 200 uses feedback control to keep the objects on the desired trajectories. Using active sensing and feedback control helps to correct the deviations from the desired trajectories in real time, and allows the object to be moved with high accuracy.

Since the object movement is monitored in real time, any situation arising in which a collision or other disruptive event may occur is detected by the modular object handling system 200. The trajectories are replanned accordingly to avoid the collision or other disruptive event. If the situation cannot be corrected by simply replanning the trajectories, the modular object handling system 200 can be controlled to bring the objects moving along the path 240 to a graceful halt.

Finally, using more active feedback control to handle objects reduces the required accuracy of the module actuators 230. It is possible to handle objects with less precisely manufactured module actuators 230 since the accuracy is maintained by sensing and control. Because the cost of the system and module controllers 210 and 220 is becoming cheaper, while the cost of the precision hardware is fairly constant, the overall cost of the modular object handling system 200 will decrease over time.

During operation of the modular object handling system 200 discussed above, the trajectory provided by the system controller 210 for each object takes a subset of the constraints and requirements into account. A nominal trajectory, which can be the time-optimal trajectory discussed above, is provided to represent the normal desired behavior for a single object. As such, the nominal trajectory encodes all such relevant control criteria. The relevant control criteria can include physical constraints, such as maximum object velocities when within each module actuator 230, and task requirements, such as reaching a target position at a target time and at a target velocity.

The above-described modular object handling system 200 can be used to move any object. For example, the modular object handling system 200 can be a modular media handling system for use with sheets, such as a transport system in an analog or digital copier, printer or other image forming device. In such an exemplary embodiment of the modular object handling system 200, tasks performed by module actuators 230 can include moving sheets, inverting sheets, decurling sheets, transferring images and fusing. The nominal trajectory therefore encodes the control criteria of these tasks.

In another exemplary application, the modular object handling system 200 can be a flight control system in an aircraft. In this example, the system controller 210 could be ground based, and the module controllers 220 and module actuators 230 could be onboard the aircraft. Using predetermined trajectories and trajectory envelopes may be particularly beneficial in view of recent changes in the airline industry towards implementing free flight, which allows pilots to choose their own trajectories for certain routes. Thus, the collision envelopes can be used to avoid collisions with other aircraft, and the control envelopes can be used to ensure that the aircraft reaches its destination on time.

Using the modular object handling system 200 as a flight control system entails certain differences its use as a transport system in an image forming device. For example, in an image forming device, moving sheets are handled by stationary module actuators 230. However, in a flight control system, the module actuators are onboard the object, i.e., the aircraft. Thus, the constraints of an aircraft, such as dynamics, maximum acceleration of the aircraft's engines, etc., travel with the aircraft, while the constraints of a sheet, such as the maximum acceleration of a certain module actuator 230, depend on the location of the sheet within the image forming device.

In yet another exemplary application, the modular object handling system 200 can be an assembly line control system of a product assembly line, such as a newspaper printing press. In this example, the path 240 would be the assembly line, and the module actuators 230 would control regions along the assembly line. The nominal trajectories could be predetermined based on nominal performances of the module actuators 230.

FIG. 3 is a graph of a typical time-distance nominal trajectory for the lead edge of a sheet when the modular object handling system 200 is a modular recording media handling system of an image forming device and the objects are sheets of recording media. As discussed above, cubic splines constitute only one possible manner of representing the time-distance trajectories.

When the modular media handling system 200 is operating, the system controller 210 communicates relevant pieces of this nominal trajectory as reference trajectories to the module controllers 220. The system controller 210 delegates local control to the module controllers 220. For example, if the trajectory contains entry and exit times and velocities of each module actuator 230, then only these times and velocities have to be communicated to the corresponding module controllers 220. The module controllers 220 can then reconstruct the necessary information for the behaviors of the sheets between each sheet's entry and exit from the respective module actuators 230.

As discussed above, deviations from the nominal trajectory typically occur during the operation of the modular media handling system 200. For minor deviations from the nominal trajectory, all control can be left to the module controllers 220. The module controllers 220 do not need to be concerned with the behaviors of other module controllers 220 and other module actuators 230, and those sheets outside of the module actuators 230 that are under the control of such other module controllers 220 and module actuators 230. The module controllers 220 also do not need to be concerned with whether the overall control criteria are satisfied, such as whether the target time will be met, or whether sheets are about to collide.

In contrast, the system controller 210 is concerned with the behaviors of the module actuators 230 and whether the overall control criteria are satisfied. When the behaviors of one or more module actuators 230 deviate from the expected behaviors, the system controller 210 determines what is happening, the potential effects, and how to correct or compensate for these deviations. In particular, deviation from the nominal trajectory may violate the constraints and requirements described above, which could lead to sheet collision, missing the target, or violating one or more optimality criteria. Thus, if a sheet is delayed within a module actuator 230, the system controller 210 has to determine whether subsequent sheets might collide, inform the relevant module controllers 220 involved, and possibly even generate new trajectories.

One primary duty of the system controller 210 is to determine which control criteria are violated. The system controller 210 can determine the status of various control criteria. For example, the system controller 210 could determine whether the objects are on track. This can be determined by checking whether the behavior of the module actuator 230 is sufficiently close to the nominal trajectory. If so, no further monitoring is required.

Determining the status of the control criteria, as well as identifying and reacting to the determined states, may require complex determinations, such as the various techniques discussed above, and can involve constraints from multiple module actuators 230 and sheets. Some problems, such as determining whether the target can still be reached, could even require replanning the entire trajectory from the current position, which may be difficult to accomplish in real time. Thus, since the control routines are continuously being performed, in order to respond in real time, the system controller 210 may have to resort to approximate determination and heuristics to identify the effects of deviations and to replan trajectories.

It may therefore be desirable to provide system-level control and monitoring systems and methods that replace these expensive and complex methods with simpler systems and methods for retrieving, combining and comparing trajectories and trajectory envelopes.

This can be accomplished by using predetermined trajectories and trajectory envelopes encoding various combinations of the system constraints and task requirements. Trajectory envelopes denote regions around other trajectories that indicate control criteria of interest. For example, instead of continuously checking the distance between objects to monitor the objects to avoid collisions, a predetermined collision envelope around the nominal trajectory can be used. Thus, as long as each object is within that object's collision envelope, the objects will not collide. The collision envelope can be determined in a similar manner as the safety region discussed above. However, instead of being continuously determined, the collision envelope can be determined prior to operation of the system.

In another exemplary embodiment, if an object deviates from its nominal trajectory, rather than replanning the trajectory for all module actuators 230 to determine whether the target can still be met, the modular object handling system 200 uses a control envelope. Thus, as long as an object remains within that object's control envelope, the object will still be able to reach the target. A trajectory envelope can be represented by one or more trajectories, which would, for example, denote the borders of the region of interest.

Thus, predetermined trajectory envelopes can be used to encode the control criteria of interest, together with multiple predetermined trajectories that denote control and collision boundaries. Different trajectory envelopes represent different control criteria. By comparing the current state (position, velocity, etc.) of an object with those predetermined trajectory envelopes, the system controller 210 is able to quickly determine the extent to which the state satisfies the criteria. The comparison operator depends on what the trajectory envelope encodes. For example, with a time-distance trajectory envelope, provided in a format similar to the nominal trajectory shown in FIG. 3, the system controller 210 only needs to test whether an object's position at the current time is to the left or right of the envelope boundary. Because those of ordinary skill in the art will be able to readily appreciate how to compare the current position of an object to the predetermined trajectory envelopes for different space-times, from the above description of a distance-time space, a detailed description of such comparisons is omitted.

The trajectories and trajectory envelopes can be determined using any appropriate known or later devised method. For example, the trajectories and trajectory envelopes can be arrived at in accordance with the determinations used to determine appropriate control and collision safety regions, such as, for example, optimal control and collision safety regions.

Regardless of how the trajectories and the trajectory envelopes are determined, predetermining the trajectories and the trajectory envelopes simplifies the control routines to merely include a comparison between the trajectories and the trajectory envelopes. This allows the system controller 210 to avoid having to determine the trajectories and the trajectory envelopes in real time during operation of the modular object handling system 210.

FIG. 4 is a graph showing the trajectories and the trajectory envelopes for sample system and task constraints. For example, a nominal trajectory 400 is shown as approximately bisecting the distance-time plane. FIG. 4 also shows a collision envelope 500 defined by an early collision trajectory 510, to the left of i.e., prior in time to, the nominal trajectory 400, and a late collision trajectory 520, to the right of, i.e., after in time to, the nominal trajectory 400. The early collision trajectory 510 defines the earliest time that an object can depart from a certain point on the path 240 at a certain velocity and not collide with another object, such as the object immediately ahead of that object on the path 240. The late collision trajectory 520 constitutes the latest time that an object can depart from a certain point on the path 240 at a certain velocity and not collide with another object, such as the object immediately behind that object on the path. This early-late collision envelope 500 can thus be used to encode a certain minimum distance between a certain object and the objects preceding and succeeding that object. As long as the object stays within that object's collision envelope 500, and the preceding and succeeding objects do not deviate more than a minimum distance from their nominal trajectories, then the objects will not collide.

FIG. 4 also shows a control envelope 600 defined by an early control trajectory 610, to the left of, i.e., prior in time to, the nominal trajectory 400, and a late control trajectory 620, to the right of, i.e., after in time to, the nominal trajectory 400. The early control trajectory 610 constitutes the earliest time that an object can depart from a certain point on the path 240 at a certain velocity and still accomplish its task. The late control trajectory 620 constitutes the latest time that an object can depart from a certain point on the path 240 at a certain velocity and still accomplish its task. The early-late control envelope 600 can thus be used to encode a certain location at which the object must be located. As long as the object stays within that object's control envelope, then the object will be able to accomplish its task.

The above-described late control trajectory 620 constitutes the latest time that an object can depart from a certain point at a certain velocity and still accomplish its task, for an object that enters the first module actuator 230 at the same time that the object is scheduled to enter the first module actuator 230 according to the nominal trajectory 400. In other words, the late control trajectory 620 enters the first module actuator 230 at the same time as the nominal trajectory 400. However, FIG. 4 also shows a latest control trajectory 630 that constitutes that latest time that an object can enter the first module actuator 230 and still accomplish its task. Thus, the latest control trajectory 630 enters the first module actuator 230 after the nominal trajectory 400 enters the first module actuator 230.

Each of the trajectories 400, 510, 520, 610, 620, 630 and the trajectory envelopes 500, 600 can be represented as a sequence of tuples. For example, in a modular object handling system 200, where the $n^{th}$ module actuator 230 is the last module actuator 230, and the $j^{th}$ module actuator 230 is one of the module actuators 230 between the first and $n^{th}$ module actuators 230, the sequence of tuples can be represented as $t_0, v_0-t_1, v_1 \ldots, t_{j-1}, v_{j-1}-t_j, v_j \ldots, t_{n-1}, v_{n-1}-t_n, v_n$. In these tuples, $t_0$ and $v_0$ represent the time and velocity of an object entering the first module actuator 230, $t_1$ and $v_1$ represent the time and velocity of an object exiting the first module actuator 230, $t_{j-1}$ and $v_{j-1}$ represent the time and velocity of an object entering the $j^{th}$ module actuator 230, and $t_j$ and $v_j$ represent the time and velocity of an object exiting the $j^{th}$ module actuator 230. Similarly, $t_{n-1}$ and $v_{j-1}$, and $t_n$ and $v_n$, represent the entry and exit times and velocities of an object relative to the $n^{th}$, or last, module actuator 230.

In operation, each object is provided with an appropriate main nominal trajectory as its reference trajectory. The responsibility to maintain each object within that object's main nominal trajectory is distributed among the module controllers 220. That is, the module controllers 220 attempt to keep each object on its particular main nominal trajectory. The system controller 210 is then called repeatedly to assess the current state for all objects in a sequence and take action as necessary. In particular, the system controller 210 monitors object distances in the particular space-time, identifies collisions, delays objects to avoid collisions when feasible, and aborts the object's travel along the path 240 if the target can no longer be achieved. The significant real-time determinations are the comparisons of object positions with trajectories and other positions. This simple collision avoidance mechanism uses one trajectory envelope to identify possible collisions and other envelopes to check whether an object is still controllable. The system controller 210 can then instruct a module controller 220 locally to delay or advance a particular object by a certain amount.

The control systems and methods of this invention work particularly well if deviations are minor or uniform. In such a situation, all objects can be delayed in the same modules.

FIG. 5 is a flowchart outlining one exemplary embodiment of a method for using predetermined trajectories and trajectory envelopes in system level control of a multi-level modular object handling system. In this embodiment, the collision envelope is smaller than the control envelope, as shown in FIG. 4.

Beginning in step S1000, control continues to step S1100, where an object is selected for analysis. Once the object is selected, control continues to step S1200, where a determination is made whether the object is within its predetermined collision envelope, i.e., whether the object is likely to collide with either preceding or succeeding objects. If the object is within its predetermined collision envelope, control returns to step S1100 where another object is selected for analysis. A determination does not need to be made as to whether the object is within its control envelope, since as discussed above, the collision envelope is smaller than the control envelope. Thus, if the object is within its collision envelope, then it must also be within its control envelope. Alternatively, if the object is not within its collision envelope, control continues to step S1300.

In step S1300, a determination is made whether the object is within its control envelope, i.e., whether the object is likely to be able to accomplish its assigned task. If the object is within its control envelope, then control continues to step S1400. Otherwise, control jumps to step S1500. In step S1400, the object is recorded as potentially colliding. The potentially colliding record can then be used to make a subsequent selection of an appropriate predetermined collision envelope for other objects. Only then would it be necessary to compute the actual distance between the potentially colliding objects and to take action as indicated above, e.g., to delay one of the objects.

The object is potentially colliding since the object was determined in step S1200 as being outside of its collision envelope. However, since the object is determined in step S1300 as being within its control envelope, control then returns from step S1400 to step S1100 where another object is selected for analysis.

Alternatively, in step S1500, a determination is made whether the nominal trajectory, collision envelope and/or control envelope should be replanned. If so, control continues to step S1600. Otherwise, control jumps to step S1700. In step S1600, one or more of the nominal trajectory, collision envelope and/or control envelopes are replanned. This can also result in a modification of the system task requirements. Control then returns to step S1100, where another object is selected for analysis.

Alternatively, if it is determined that the nominal trajectory, collision envelope and/or control envelope should not be replanned, then control continues to step S1700 where the analysis is terminated.

Figure 6:
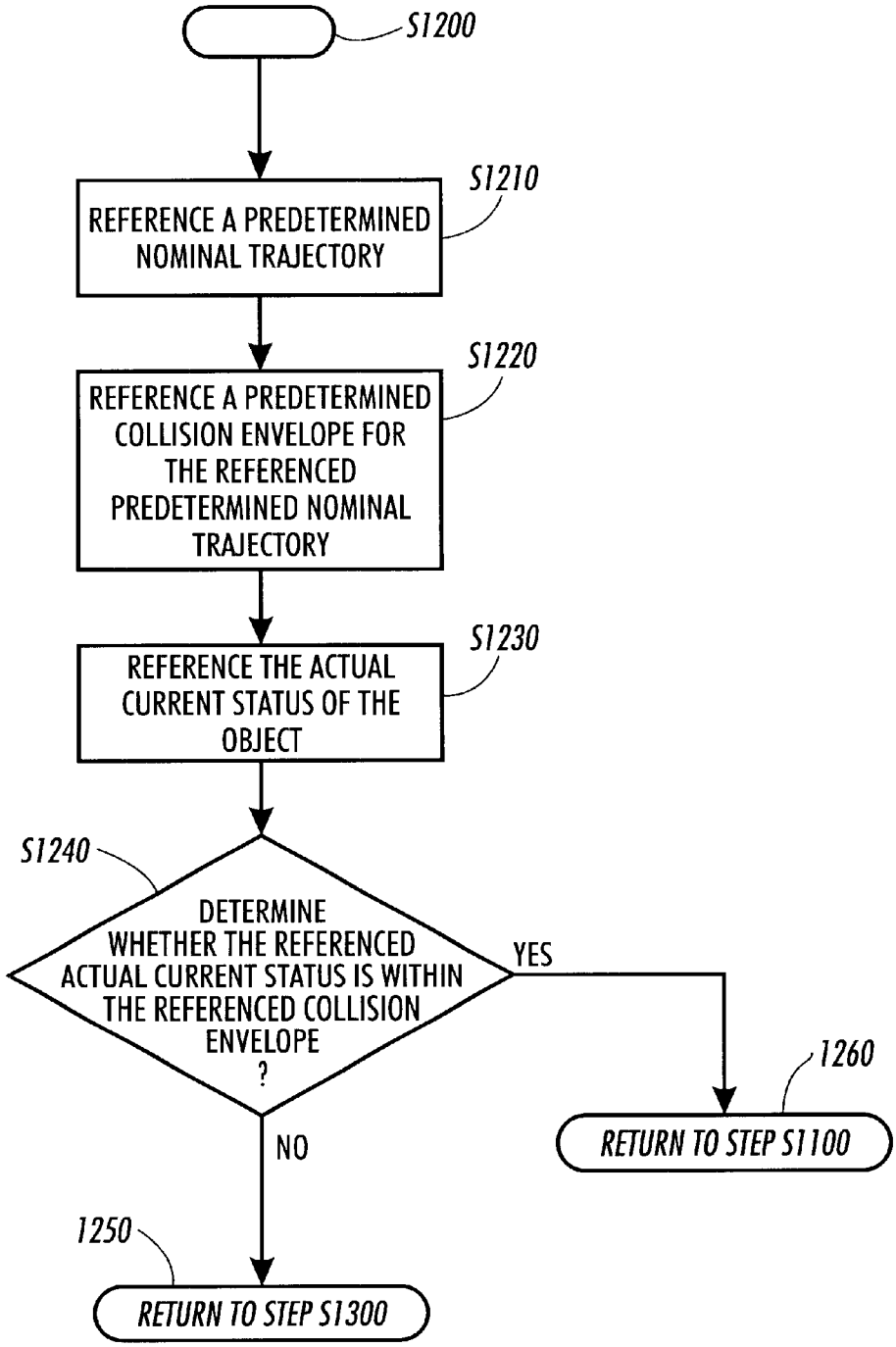
FIG. 6 is a flowchart outlining in greater detail one exemplary embodiment of a method for determining if the object is within its collision envelope of step S1200 of FIG. 5.

FIG. 6 is a flowchart outlining in greater detail one exemplary embodiment of a method for determining if the object is within its collision envelope of step S1200 of FIG. 5. Beginning in step S1200, control continues to step S1210, where a predetermined nominal trajectory for the object is referenced. Then, in step S1220, a predetermined collision envelope is referenced for the referenced predetermined nominal trajectory. Next, in step S1230, the actual current status, such as velocity, acceleration and/or position, of the object is referenced. Control continues to step S1240.

In step S1240, a determination is made whether the referenced actual current status of the object is within the referenced collision envelope for that time. If so, control returns to step S1100 of FIG. 5. If not, control returns to step S1300 of FIG. 5.

Figure 7:
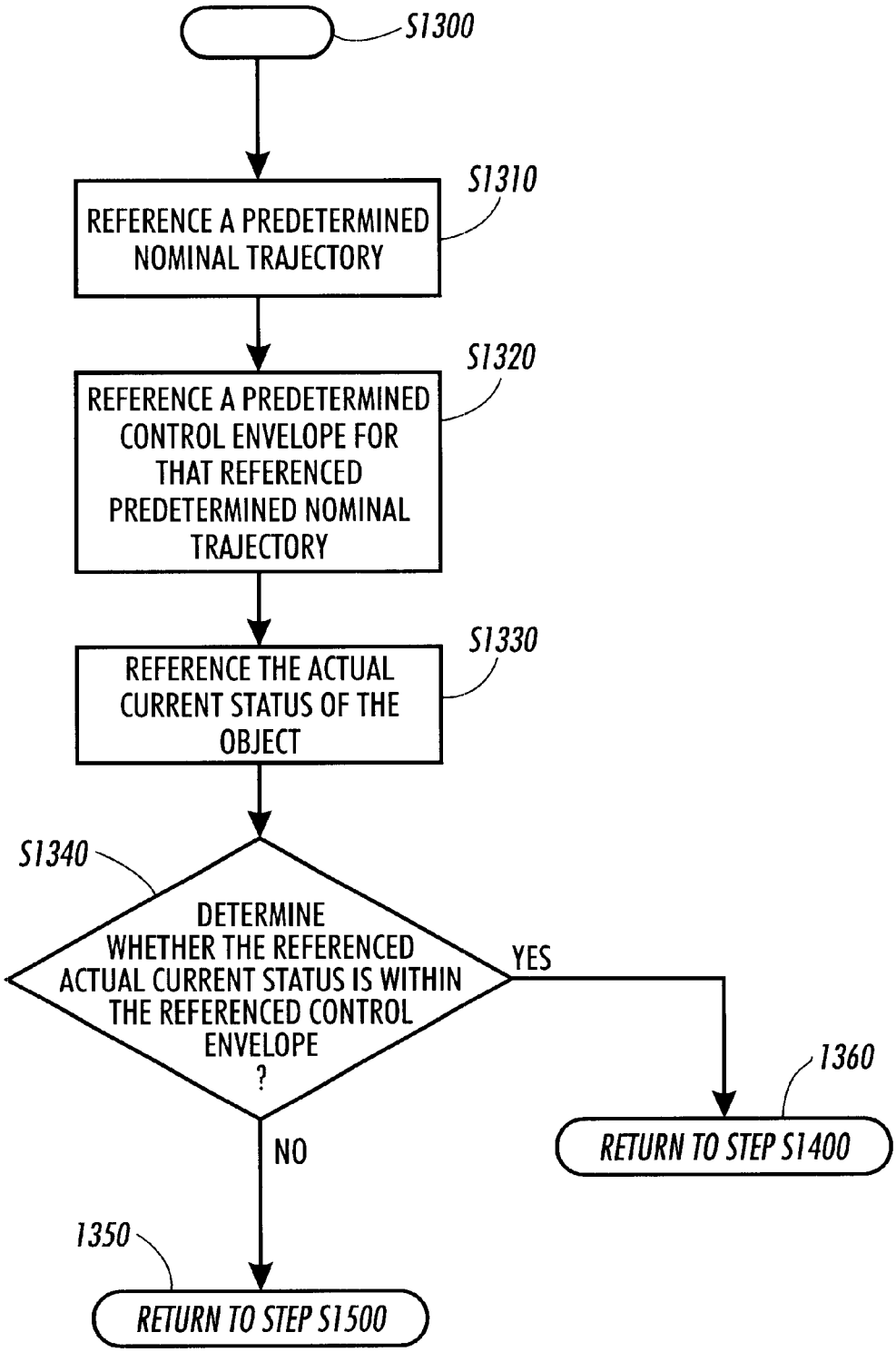
FIG. 7 is a flowchart outlining in greater detail one exemplary embodiment of a method for determining if the object is within its control envelope of step S1300 of FIG. 5.

FIG. 7 is a flowchart outlining in greater detail one exemplary embodiment of a method for determining if the object is within its control envelope of step S1300 of FIG. 5. Beginning in step S1300, control continues to step S1310, where a predetermined nominal trajectory of the object is referenced. This referenced predetermined nominal trajectory can be the same nominal trajectory of step S1200. Next, in step S1320, a predetermined control envelope is referenced for the referenced predetermined nominal trajectory. Then, in step S1330, the actual current status, such as velocity, acceleration and/or position, of the object is referenced. This actual current status of the object can be the same object status of step S1200. Control then continues to step S1340.

In step S1340, a determination is made whether the referenced actual current status of the object is within the referenced control envelope for that time. If so, control returns to step S1400 of FIG. 5. If not, control returns to step S1500 of FIG. 5.

In accordance with another exemplary embodiment of the methods for using predetermined trajectories and trajectory envelopes of this invention, the control envelope could be smaller than the collision envelope. A flowchart illustrating this alternative exemplary embodiment would be similar to the flowchart of FIG. 5, except that steps S1200 and S1300 would be juxtaposed. Thus, a first determination would be made whether the object is within its control envelope. If not, then a second determination would then be made whether the object is within its collision envelope.

In other exemplary embodiments of the apparatus and methods for using predetermined trajectories and trajectory envelopes of this invention, the trajectories and trajectory envelopes are predetermined by explicitly representing the system constraints and task requirements. The trajectories and trajectory envelopes can be predetermined by manually performing determinations, such as by manually encoding cubic splines to explicitly represent the system constraints and task requirements.

Manually determining the cubic splines can also entail treating the system constraints differently from the task requirements. For example, the system constraints can be manually treated as hard constraints for all possible trajectories and trajectory envelopes. That is, all trajectories and trajectory envelopes are manually predetermined to satisfy the system constraints. In contrast, at least some of the task requirements can be manually treated as merely constituting soft limits that apply only to the normal trajectory. That is, these task requirements can be violated by certain trajectories and trajectory envelopes.

Manually determining the cubic splines can be performed when creating a new modular object handling system 200. Manually determining the cubic splines can also be performed when modifying an existing modular object handling system 200 by changing the constraints or the arrangement of the module actuators 230.

However, manually determining the cubic splines can be tedious and time consuming. Thus, in still other exemplary embodiments of the apparatus and method for using predetermined trajectories and trajectory envelopes of this invention, the trajectories and trajectory envelopes are automatically predetermined. In fact, explicitly representing the system constraints and task requirements lends itself to automatically predetermining the trajectories and trajectory envelopes. For example, because the system constraints and task requirements are explicitly represented, the trajectories and trajectory envelopes can be automatically predetermined upon adding new constraints created when the control criteria are changed.

The explicitly represented system constraints and task requirements enable each of the module actuators 230 to be described independently. Describing each of the module actuators 230 independently in terms of the system constraints and/or task requirements allows the trajectories and trajectory envelopes to be automatically predetermined once the arrangement of module actuators 230 is specified. Thus, the trajectories and trajectory envelopes can be automatically predetermined for various system configurations. This tendency toward automatic predetermination of trajectories and trajectory envelopes is especially apparent to one of ordinary skill in the art based upon the following description of the separately explicitly represented system constraints and task requirements for each module actuator 230.

Generally, the system constraints and task requirements can be described in terms of physical constraints, task constraints, user preferences, optimality and robustness. Examples of physical constraints include maximum module actuator 230 actuation forces, maximum object velocities, maximum velocity differentials between the module actuators 230, and minimum object distances. Examples of task constraints include target object positions and times, and maximum and average object velocities. Examples of user preferences include specific transport strategies and object orders. An example of optimality includes overall throughput. An example of robustness includes buffer regions for average object behavior variability.

More specifically, the system constraints include the combined constraints of all of the module actuators 230. Each module actuator 230 is subject to a specific set of module constraints. For example, each module actuator 230 has maximum and minimum velocity limits and maximum and minimum acceleration limits. Thus, the velocities and accelerations in a trajectory are limited by the minimum and maximum velocities and accelerations of each of the module actuators 230.

Controlling multiple module actuators 230 together also creates module constraints. Specifically, the velocities of objects moving along trajectories within different module actuators 230 that are controlled together must be equal. If not, then other controls will not be able to be applied in unison to the objects within the different module actuators 230.

As another example, placing two module actuators 230 adjacent to each other creates module constraints. Specifically, the difference in velocities between the two adjacent module actuators 230 is limited. If not, objects may be damaged as the objects are transferred from one module actuator 230 to the adjacent module actuator 230.

The task requirements can also be specifically described in terms of the individual module actuators 230, such as the target criteria of a certain module actuator 230. For example, accomplishing a certain task may require that an object exit a certain module actuator 230 at a specified velocity. Target criteria can also include a requirement that the arrivals of the objects be separated by a specified time period p when arriving at a certain module actuator 230.

Task requirements can also take into account collision avoidance at certain module actuators 230. For example, certain tasks may require that a minimum gap g between objects be maintained at a certain module actuator 230 to avoid collisions.

Task requirements can also require taking into account velocity and acceleration limits at certain module actuators 230. For example, average travel velocities and maximum accelerations may be imposed on the nominal trajectory to accomplish a certain task at a certain module actuator 230. Violating the average travel velocity or maximum acceleration may make it impossible to accomplish a certain task of that module actuator 230.

Figure 8:
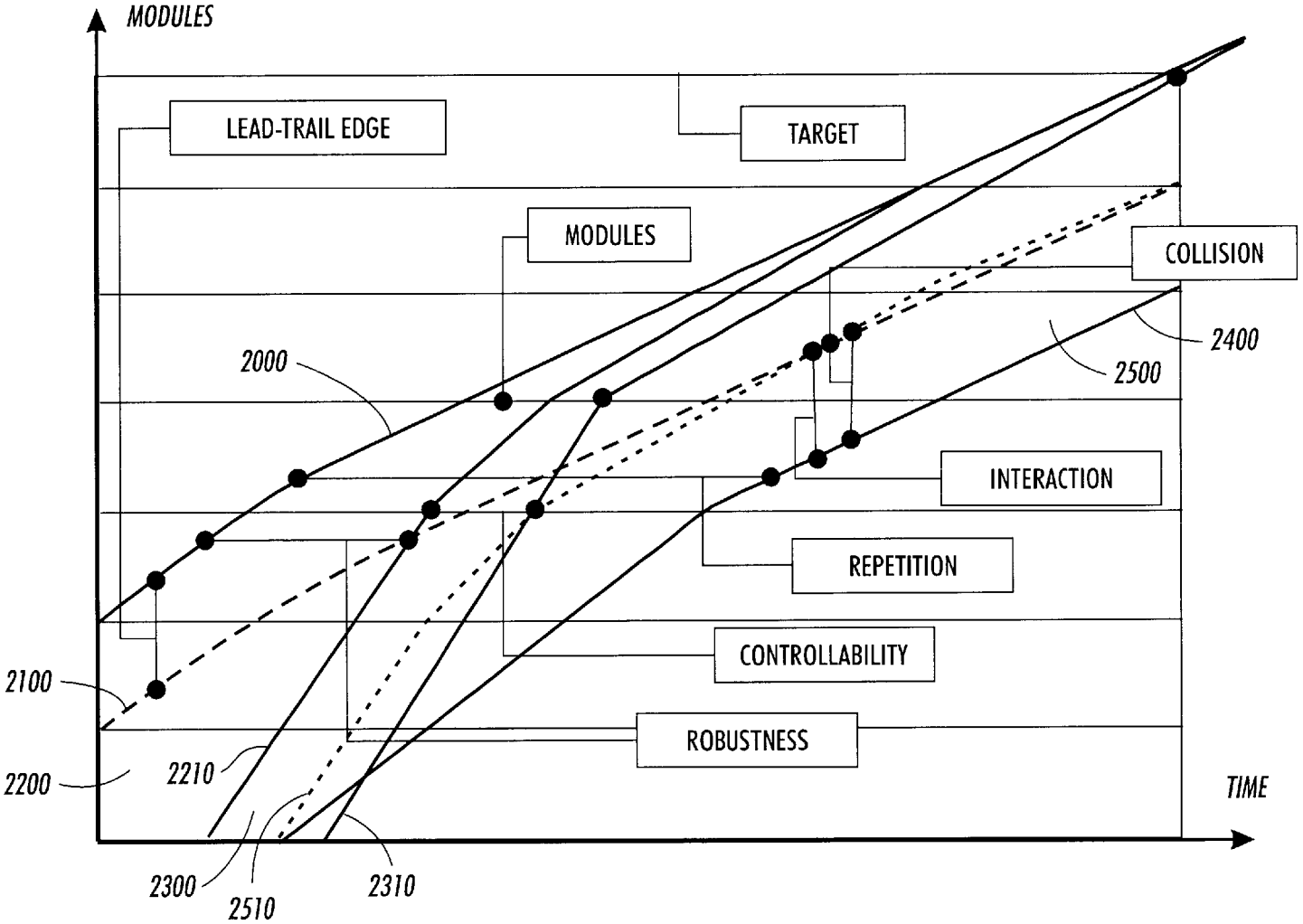
FIG. 8 is a graph showing trajectories and trajectory envelopes, as well as the system constraints and task requirements that are defined by the trajectories and trajectory envelopes.

The system constraints and task requirements can also be depicted graphically. For example, FIG. 8 is a graph showing trajectories and trajectory envelopes, as well as the system constraints and task requirements that are defined by the trajectories and trajectory envelopes. The x-axis of FIG. 8 represents time, and the y-axis represents the various module controllers 230 of the modular object handling system 200. The modular object handling system 200 represented by FIG. 8 includes 7 module actuators 230.

As will be evident from the following description, the trajectory envelopes of FIG. 8 are defined differently than the trajectory envelopes shown in FIG. 4. For example, in FIG. 4, the trajectory envelopes 500 and 600 are defined between boundary trajectories 510 and 520, and 610 and 620 that are disposed on opposing sides of the nominal trajectory 400. In contrast, in FIG. 8, the trajectory envelopes are defined between the nominal trajectory and a boundary trajectory.

FIG. 8 shows a nominal trajectory 2000 of a leading edge of an object as well as a trajectory 2100 of a trailing edge of the object. The length of the object is shown by connecting the trajectories 2000 and 2100, i.e., the lead and trail edges of the object, with a vertical line. Accordingly, the graph of FIG. 8 shows that at the earliest indicated time, the nominal trajectory 2000 of the lead edge of the object exits the module 2 while the trajectory 2100 of the trail edge enters the module 2. Similarly, at the latest indicated time, the nominal trajectory 2000 of the lead edge of the object exits the module 7 while the trajectory 2100 of the trail edge enters the module 7.

FIG. 8 shows a robust control envelope 2200 that is defined between the nominal trajectory 2000 and a late robust control trajectory 2210. The late robust control trajectory 2210 represents the latest time that an object can depart from a certain point on the path 240 at a certain velocity and still accomplish its task under a specified failure model, such as, for example, upon the failure of an operation of a certain module actuator 230 along the path 240. Thus, the robust control envelope 2200 can be used to encode a certain location at which the object must be located to be able to accomplish its task under a specified failure model.

FIG. 8 also shows a control envelope 2300 that is defined between the nominal trajectory 2000 and a late control trajectory 2310. The late control trajectory 2310 represents the latest time that an object can depart from a certain point on the path 240 at a certain velocity and still accomplish its task. Thus, the control envelope 2300 can be used to encode a certain location at which the object must be located to be able to accomplish its task.

The control envelope 2300 is different from the robust control envelope 2200 since it does not take into account a specified failure module. Thus, the late control trajectory 2310 is able to enter and exit each module at a later time than the late robust control trajectory 2210 and still accomplish its task.

However, the control envelope 2300 and robust control envelope 2200 are otherwise similar. For example, the late robust control trajectory 2210 and the late control trajectory 2310 each do not enter the first module until after the earliest time shown in FIG. 8. The late robust control trajectory 2210 and the late control trajectory 2310 each exit module 7 at the same time as the nominal trajectory 2000. Thus, the nominal trajectory 2000, late robust control trajectory 2210 and late control trajectory 2310 all have the same target, but have different entry times.

Certain system constraints and task requirements can be graphically represented based upon the nominal trajectory

2000, the late robust control trajectory 2210 and the late control trajectory 2310. For example, robustness can be depicted as a horizontal line extending between the nominal trajectory 2000 and the late robust control trajectory 2210. Controllability can be depicted as a horizontal line extending between the late robust control trajectory 2210 and the late control trajectory 2310.

FIG. 8 additionally shows a nominal trajectory 2400 for a second object and a collision envelope 2500 for that second object. The collision envelope 2500 is defined between the nominal trajectory 2400 and an early collision trajectory 2510 for the second object. For example, the collision envelope 2500 for a certain time can be represented as a vertical line extending between the nominal trajectory 2400 and the early collision trajectory 2510 of the second object at that time. The early collision trajectory 2510 constitutes the earliest time that the second object can depart from a certain point on the path 240 at a certain velocity and not collide with the first object having the nominal trajectory 2000. Thus, the collision envelope 2500 can be used to encode a certain location at which the second object must be located so as not to collide with the first object.

Other system constraints and task requirements can be graphically represented by including the nominal trajectory 2400 and the early collision trajectory 2510 of the second object. For example, repetition can be depicted as a horizontal line extending between the nominal trajectory 2000 of the first object and the nominal trajectory 2400 of the second object. Interaction can be depicted as a vertical line extending between the nominal trajectory 2400 of the second object and the trajectory of the trailing edge 2100 of the first object.

Based on the graph of FIG. 8, one of ordinary skill in the art will find it evident that other trajectories and trajectory envelopes can be determined by building on other trajectories. For example, all other trajectories and trajectory envelopes can be determined by using constraints that are based on the nominal trajectory.

FIG. 8 shows that the end time of the nominal trajectory 2000 is used as an end time constraint for other trajectories and trajectory envelopes. In other words, other trajectories and trajectory envelopes shown in FIG. 8 are determined so those other trajectories and trajectory envelopes end at the same time as the nominal trajectory.

For example, FIG. 8 shows that the late robust control trajectory 2210 and the late control trajectory 2310 are determined to end at the same time and location as the nominal trajectory 2000 of the one object. The robust control envelope 2200 and the control envelope 2300, which are defined by the late robust control trajectory 2210 and the late control trajectory 2310, respectively, are also therefore determined to end at the same time and location as the nominal trajectory 2000 of the one object.

The collision envelopes can similarly be determined by using constraints that are based on the nominal trajectory. For example, FIG. 8 shows that start and end times of the nominal trajectories of the objects are used as start and end time constraints of the collision envelope 2500 and the early collision trajectory 2510 of the other object.

Specifically, FIG. 8 shows that the early collision trajectory 2510 is determined to begin at the same time and location as the nominal trajectory 2400 of the other object. The early collision trajectory is also determined to end at the same time and location as the trajectory 2100 of the trailing edge of the first object. The collision envelope 2500 of the second object, which is defined between the early collision trajectory 2510 and the nominal trajectory 2400 of the second object, is also determined by these constraints.

Figure 9:
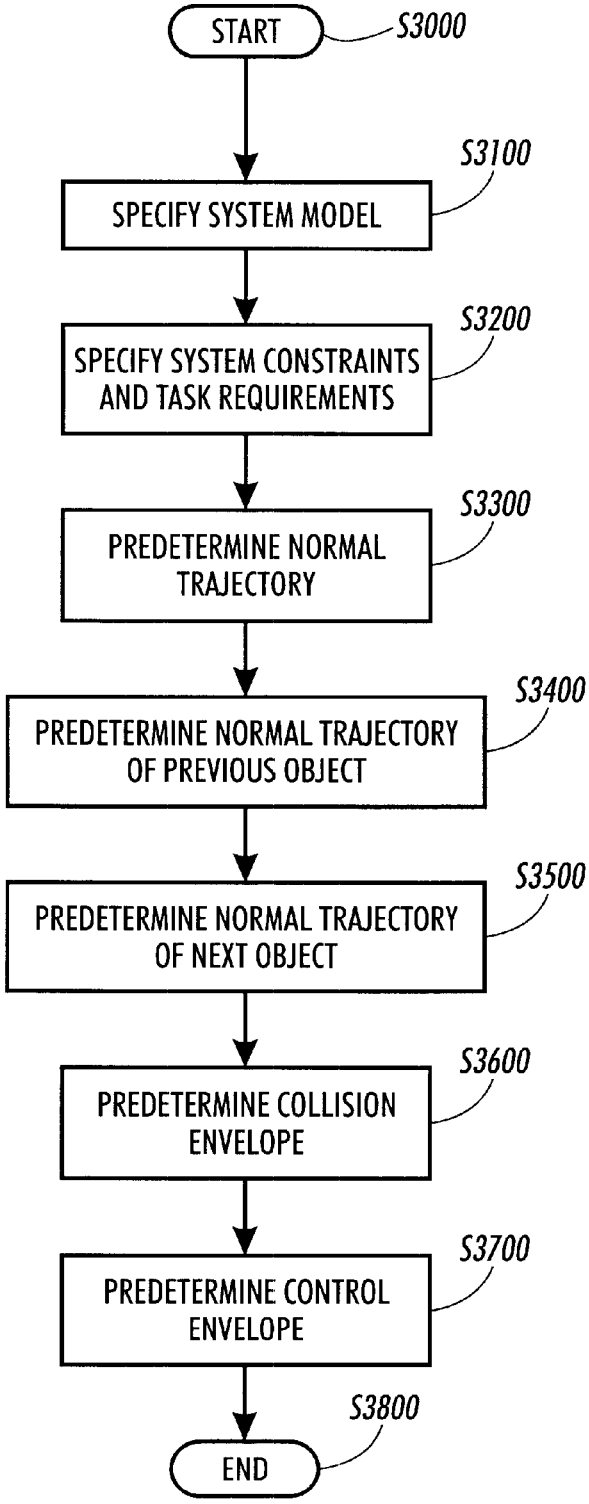
FIG. 9 is a flowchart outlining one exemplary embodiment of a method for predetermining trajectories and trajectory envelopes by explicitly representing the system constraints and task requirements.

FIG. 9 is a flowchart outlining one exemplary embodiment of a method for predetermining trajectories and trajectory envelopes by explicitly representing the system constraints and task requirements. In this exemplary embodiment, the trajectories and trajectory envelopes can be automatically predetermined.

Beginning in step S3000, control continues to step S3100, where the system model is specified. Specifying the system model can entail at least specifying the number of individual module actuators, the types of the specified module actuators, and the configuration of the specified module actuators. For example, the system model can be specified as 3 modules, of type 1, configured in a serial formation. The type designation "type 1" merely constitutes an arbitrary designation of a type of the module actuators. As discussed below each type of module has a distinctive set of module constraints and task requirements.

Once the system model is specified, control continues to step S3200, where the system constraints and task requirements are specified. As discussed above, the system constraints are made up of the combined constraints of all of the module actuators. Further, each type of module actuator, such as the exemplary type 1 module actuator, is subject to a distinctive set of constraints, such as maximum and minimum velocity and maximum and minimum acceleration limits, as well as constraints created by controlling multiple module actuators together and disposing the specified module actuators adjacent to each other.

Also, as discussed above, the task requirements can additionally be described in terms of the individual module actuators. For example, accomplishing a certain task may subject a module actuator, such as the exemplary type 1 module actuator, to a variety of constraints, such as, for example, target criteria, collision avoidance and velocity and acceleration limits.

Examples of the system constraints and task requirements for the exemplary type 1 module actuator include, for example, that each type 1 module actuator can have such module constraints as a length of 25.4 mm, a minimum velocity $v_{min}$ of an object traveling through that module actuator of −3.0 mm/ms, a maximum velocity $v_{max}$ of an object traveling through that module actuator of 3.0 mm/ms; a minimum acceleration $a_{min}$ of an object traveling through that module actuator of −0.02 mm/ms$^2$; and a maximum acceleration $a_{max}$ of an object traveling through that module actuator 230 of 0.02 mm/ms$^2$.

Each type of the module actuators can also have a variety of general task constraints that may need to be satisfied for that type of module actuator to accomplish its designated task. For example, in accordance with general task constraints of the type 1 module actuator, an object may need to have an initial velocity $v_0$ of 0.0 mm/ms, and an ending velocity $v_n$ of 0.5 mm/ms. The type 1 module actuator may also need to operate such that the object always travels at a velocity v within the module actuator that is $\geqq$0.0 mm/ms.

Similarly, each type 1 module actuator can have nominal task constraints that may need to be satisfied to meet other criteria, such as to enable the module actuator to operate at increased efficiency. For example, the nominal task constraints can include the general task constraints, and additionally a constraint that the module actuator operates such that the velocity v of the object within the module actuator is always $\leqq$1.0 mm/ms. Satisfying this constraint may thereby enable the module actuator to operate more quickly and reliably.

The system constraints and task requirements of the type 1 module actuators may also require that objects within the type 1 module actuators be separated by certain constraints to satisfy task requirements and/or prevent collisions with other objects. For example, the objects may need to be separated for by a period "s" of 500 ms, and by a minimum gap "g" of 30 mm.

Once the system constraints and task requirements are specified, control continues to step S3300, where a nominal trajectory $T_r$ of an object is predetermined. The nominal trajectory $T_r$ can be predetermined via a constraint solver, such as a generic constraint solver or an optimizing constraint solver, that solves the system and task constraints, such as the constraints discussed above, while minimizing associated trajectory criteria. For example, the nominal trajectory $T_r$ can be predetermined via the constraint $t_0=0$, and minimizing the constraints $t_n-t_0$, wherein $t_0$ is the time that the object enters the first module actuator 230 and $t_n$ is the time that the object exits the last module actuator 230 on the path 240.

In predetermining the nominal trajectory $T_r$, the constraints are translated to constraints on the desired trajectory, such as, for example, to constraints on the cubic splines defined by the trajectory. Constraints on entry and exit times and velocities are directly added to the cubic splines. Minimum and maximum constraints on the velocities and accelerations of entire modules can be translated to constraints on the minima and maxima of the velocity and acceleration functions defined by the cubic splines.

The set of particular task constraints depends on the trajectory's purpose. Thus, the nominal trajectory $T_r$ may satisfy all task constraints since it constitutes the desired trajectory.

After the nominal trajectory $T_r$ is predetermined, control continues to step S3400, where the nominal trajectory $T_p$ of the previous object on the path is predetermined. The previous nominal trajectory $T_p$ is predetermined by shifting the nominal trajectory $T_r$ by −s, which, as discussed above, is the period with which objects are expected to arrive at the target position.

After the previous nominal trajectory $T_p$ is predetermined, control continues to step S3500, where the nominal trajectory $T_n$ of the next object on the path is predetermined. The next nominal trajectory $T_n$ is predetermined by shifting the nominal trajectory $T_r$ by +s.

After the next nominal trajectory $T_n$ is predetermined, control continues to S3600, where the collision envelope is predetermined. The collision envelope is predetermined by predetermining the early and late collision borders.

The early collision border $T_e$ is predetermined by solving the constraints, such as, for example, the system and general task constraints, as well as the collision constraints, such as, for example, the period "s" and the gap "g", with the previous nominal trajectory $T_p$ and the next nominal trajectory $T_n$. Since the set of particular task constraints depends on the trajectory's purpose, the early and late collision borders may not need to satisfy the suggested velocity and acceleration limits. The early collision border $T_e$ can also be predetermined via the constraints $t_0=0$, and $t_n=t_n$ in the nominal trajectory $T_r$, minimizing $t_{n-1}$.

The late collision border $T_1$ is predetermined by solving the constraints, such as, for example, the system and general task constraints, as well as the collision constraints, such as, for example, the period "s" and the gap "g", with the previous nominal trajectory $T_p$ and the next nominal trajectory $T_n$. The late collision border $T_1$ can also be predetermined via the constraints $t_0=0$, and $t_n=t_n$ in the nominal trajectory Tr, minimizing $t_n-t_1$, where $t_1$ is a time between $t_0$ and $t_n$.

After the collision envelope is predetermined, control continues to S3700, where the control envelope is predetermined. The control envelope can be defined between an early control border 610 and a late control border 620, as shown in FIG. 4. Alternatively, the control envelope can be defined between the nominal trajectory 2000 and one of the late robust control trajectory 2210 and the late control trajectory 2310, as shown in FIG. 8.

In the case shown in FIG. 8, the late robust control trajectory 2210, which is also referred to herein as $T_c$, is predetermined by solving the constraints, such as, for example, the system and general task constraints. Since the set of particular task constraints depends on the trajectory's purpose, the control border $T_c$ may only satisfy the target constraints. The late robust control trajectory $T_c$ can also be predetermined via the constraint $t_n=t_n$ in the nominal trajectory $T_r$, minimizing $t_n-t_0$.

After the control envelope has been predetermined, control ends at step S3800.

The systems and methods discussed above predetermine a trajectory, such as a nominal trajectory, as well as at least one predetermined trajectory envelope that is associated with the predetermined trajectory, such as a control envelope, for each object that moves along the path 240. These systems and methods are particularly effective if the trajectory envelope, such as the control envelope, is narrow. A control envelope will be narrow if a difference between an early control trajectory and a late control trajectory is small. These systems and methods are also particularly effective if deviations from the predetermined trajectory, such as the nominal trajectory, are small and/or substantially uniform for multiple objects moving along the path 240.

However, if a predetermined trajectory envelope, such as the control envelope, is large and/or an object deviates a large amount from the predetermined trajectory, such as the nominal trajectory, then the module actuators 230 may exert a large amount of energy in attempting to place the object back on that object's predetermined nominal trajectory. Further, the module actuators 230 may exert this large amount of energy even though an alternative trajectory may exist that would still enable the object to reach the object's target but that would enable the module actuators 230 to use less energy.

For example, such an alternative trajectory may entail delaying an object to prevent a module actuator 230 from using an unnecessarily large amount of energy in attempting to reach that object's predetermined nominal trajectory. Accordingly, in various other exemplary embodiments of the systems and methods of this invention, multiple trajectories, such as nominal trajectories, are predetermined and used for each object. Separate trajectory envelopes are also predetermined and used for each of the multiple predetermined trajectories. Thus, it is possible in these exemplary embodiments of apparatus and methods of this invention to switch, for each object, between multiple predetermined trajectories to actively improve energy usage. It is also possible, in these exemplary embodiments of the systems and methods, to modify the trajectories of other objects to avoid collisions with the object whose trajectory was originally switched.

For example, multiple nominal trajectories, as well as associated trajectory envelopes for each of the multiple nominal trajectories, can be predetermined for each object. Then, it is possible, in these exemplary embodiments of the systems and methods of this invention, to monitor the status of each object, and to select another nominal trajectory for one or each of multiple objects depending on the current circumstances of operation. The newly selected nominal trajectory, as well as the newly selected nominal trajectory's trajectory envelope, can then be communicated as a new reference trajectory and associated trajectory envelope to the module controllers 220. The trajectories of the other objects moving along the path can then be switched as necessary to avoid collisions with the object moving along the newly selected trajectory.

Figure 10:
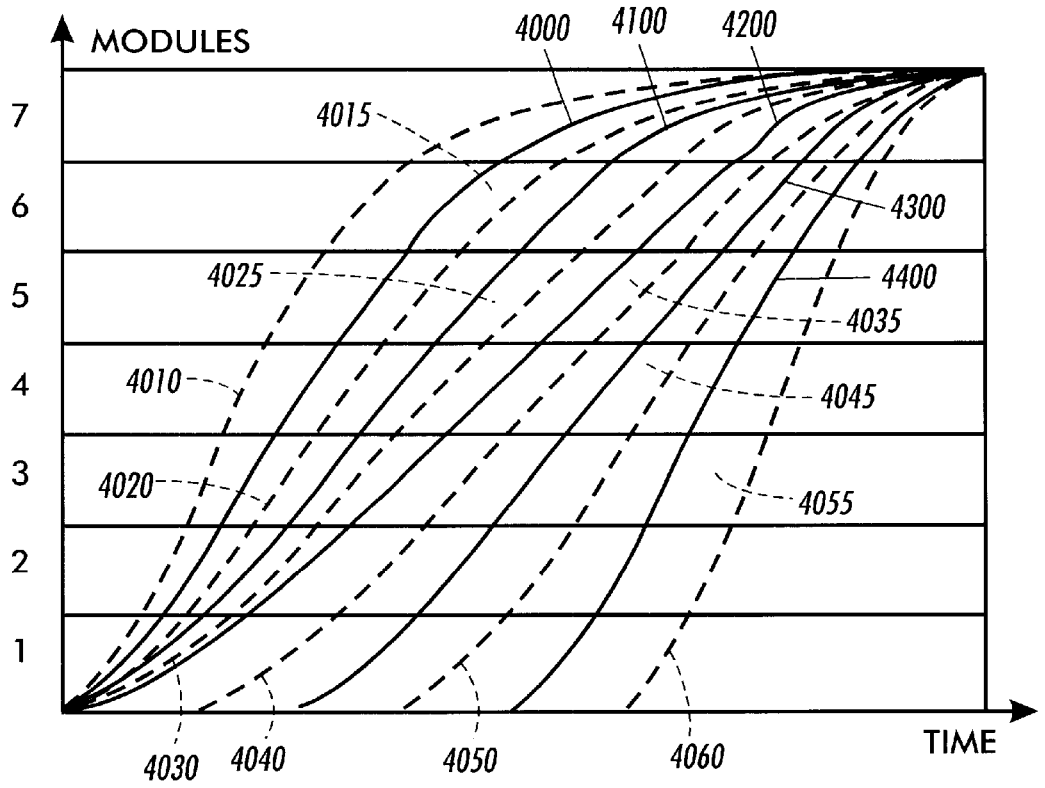
FIG. 10 is a graph showing multiple trajectories and trajectory envelopes for an object.

FIG. 10 is a graph showing multiple trajectories and trajectory envelopes for an object. The trajectories 4000, 4100, 4200, 4300 and 4400 can each represent, for example, a nominal trajectory. The trajectory regions 4015, 4025, 4035, 4045 and 4055 can define envelopes, such as, for example, control envelopes, around each of the nominal trajectories 4000, 4100, 4200, 4300 and 4400.

Specifically, a control envelope 4015 can be defined by the control trajectory boundaries 4010 and 4020 around the nominal trajectory 4000. Similarly, a control envelope 4025 can be defined by the control trajectory boundaries 4020 and 4030 around the nominal trajectory 4100. A control envelope 4035 can be defined by the control trajectory boundaries 4030 and 4040 around the nominal trajectory 4200. A control envelope 4045 can be defined by the control trajectory boundaries 4040 and 4050 around the nominal trajectory 4300. Finally, a control envelope 4055 can be defined by the control trajectory boundaries 4050 and 4060 around the nominal trajectory 4400.

These trajectories and trajectory envelopes can be predetermined by the system controller 210. The system controller 210 can select a reference trajectory among these predetermined trajectories, and communicate the selected predetermined reference trajectory to the module controllers 220. Then, depending on the circumstances, the system controller 210 can select another predetermined reference trajectory, and communicate this new reference trajectory to the module controllers 220.

Figure 11:
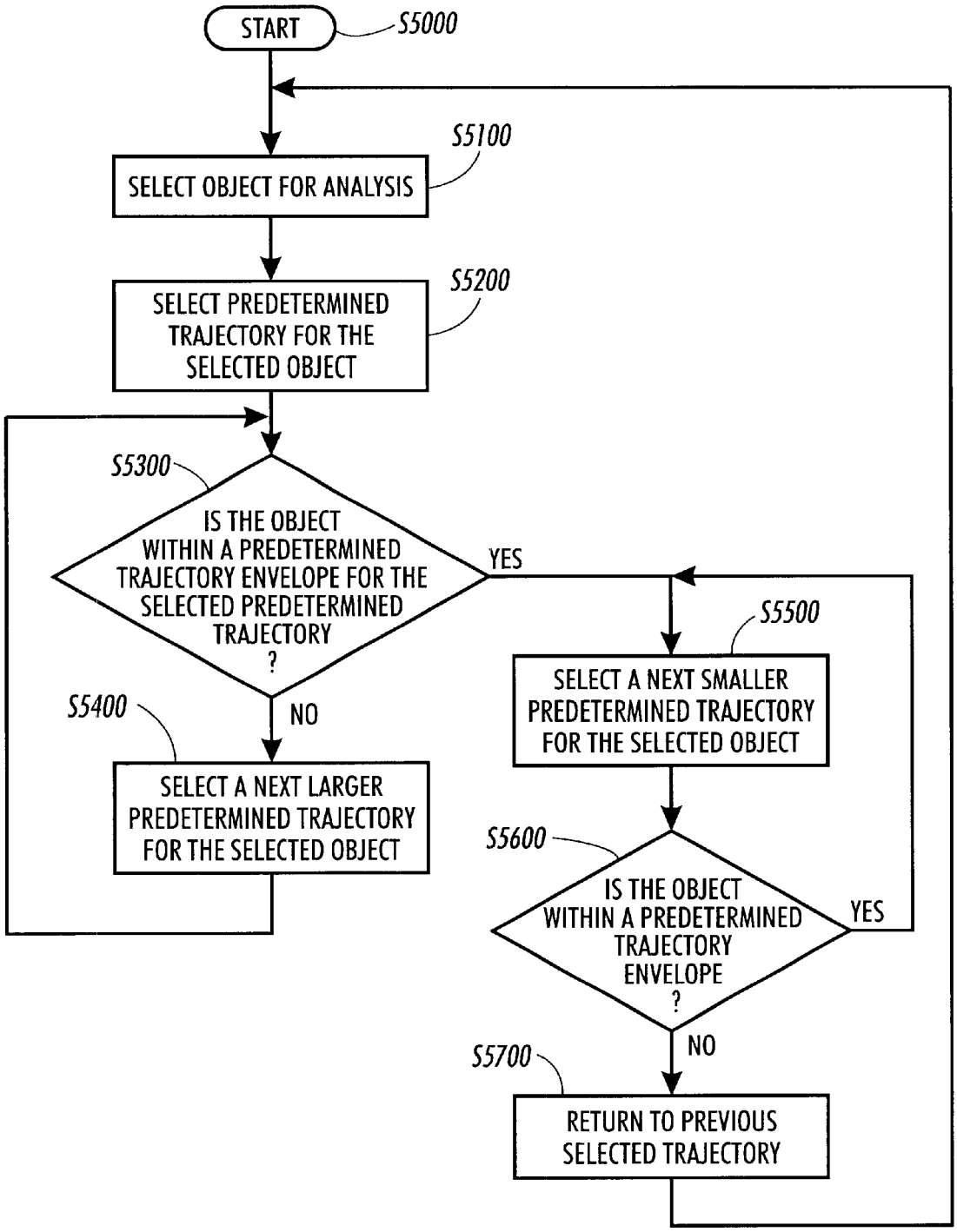
FIG. 11 is a flowchart outlining one exemplary embodiment of a method for using multiple predetermined trajectories and trajectory envelopes for each object in system level control of a multi-level modular object handling system.

FIG. 11 is a flowchart outlining one exemplary embodiment of a method for using multiple predetermined trajectories and trajectory envelopes for each object in system level control of a multi-level modular object handling system. In this exemplary embodiment of the methods, collision among multiple objects is not taken into account.

Beginning in step S5000, control continues to step S5100, where an object is selected for analysis. Once the object is selected, control continues to step S5200, where a predetermined trajectory is selected for the selected object. The selected predetermined trajectory can be, for example, the nominal trajectory 4000 shown in FIG. 10.

Once the predetermined trajectory is selected, in step S5300, a determination is made whether the selected object is within a predetermined trajectory envelope for the selected predetermined trajectory. The predetermined trajectory envelope can be, for example, the control envelope 4015. As shown in FIG. 10, the control envelope 4015 is defined by the control trajectory boundaries 4010 and 4020 around the nominal trajectory 4000.

In this example, the actual current status of the object could be referenced. The actual current status of the object would then be compared to the predetermined trajectory envelope for the selected predetermined trajectory, i.e., control envelope 4015 of FIG. 10. Thus, the determination of step S5300 can be performed similarly to steps S1200 and S1300 of FIG. 5, which are shown in greater detail in FIGS. 6 and 7, respectively.

If a determination is made in step S5300 that the object is within the predetermined trajectory envelope for the selected predetermined trajectory, then control continues to step S5500, where a next smaller trajectory is selected. In step S5600, it is determined whether the selected next smaller trajectory is within the predetermined trajectory envelope. If so, then control returns to step S5500. If not, then step S5700 returns to the previously selected trajectory. Control then returns to step S5100.

In contrast, if a determination is made in step S5300 that the object is not within the predetermined trajectory envelope for the selected predetermined trajectory, then control continues to step S5400, where a next larger predetermined trajectory is selected for the selected object. For example, if the object is at a location between the control trajectory boundary 4020 and the nominal trajectory 4100, then the object could be determined as not being within control envelope 4015, as shown in FIG. 10. In such a situation, the selected other predetermined trajectory could then be, for example, the nominal trajectory 4100.

Once the next predetermined trajectory is selected in step S5400, control returns to step S5300, where the determination of step S5300 is performed for the selected next predetermined trajectory.

It should be appreciated that, in step S5400, that the selected next larger trajectory can simply be the next larger trajectory in a predetermined order of the provided multiple trajectories. However, as shown in FIG. 11, this will require multiple passes through steps S5300 and S5400 until a predetermined trajectory is located that contains the current object. Similarly, it should be appreciated that, in steps S5500–S5700, that the next smaller trajectory can simply be the next smaller trajectory in a predetermined order of the provided multiple trajectories.

However, this may not be the most efficient method for determining which of the provided multiple trajectories to use. That is, it may be more efficient to directly determine, in steps S5400 and S5500, which of the provided multiple trajectories, is the trajectory having the minimal control envelope that contains the current object. In this case, as shown in FIG. 12, steps S5500–S5700 can be omitted, and control can jump directly from step S5400 back to step S5100.

Figure 12:
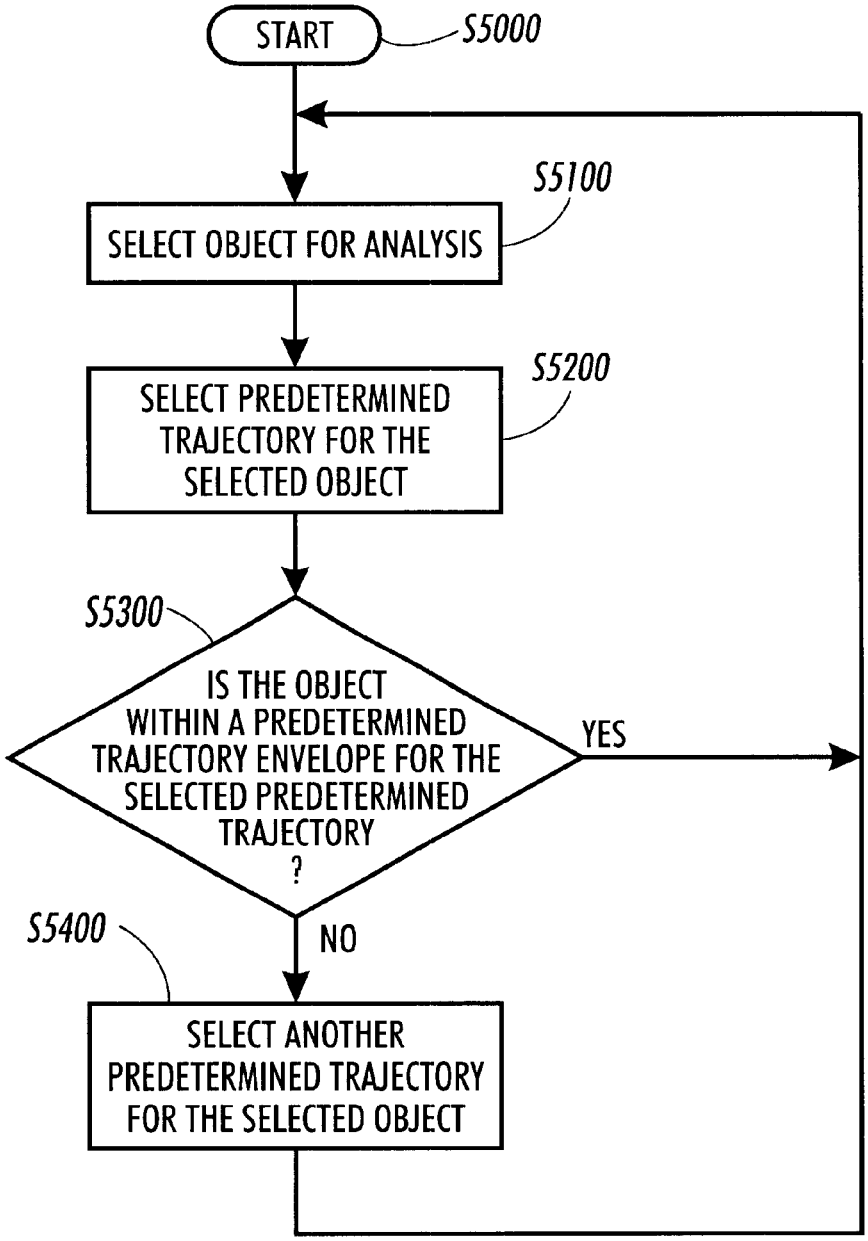
FIG. 12 is a flowchart outlining another exemplary embodiment of a method for using multiple predetermined trajectories and trajectory envelopes for each object in system level control of a multi-level modular object handling system.
Figure 13:
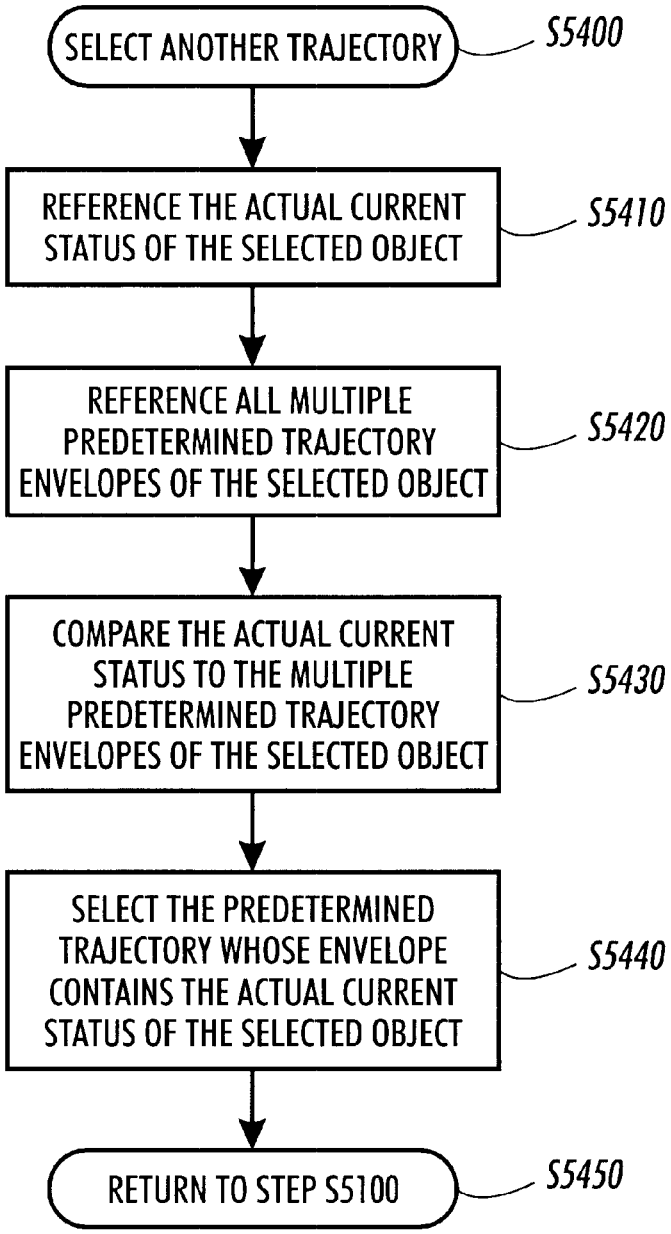
FIG. 13 is a flowchart outlining in greater detail one exemplary embodiment of a method for selecting another predetermined trajectory for the selected object.

FIG. 13 is a flowchart outlining in greater detail one exemplary embodiment of a method for selecting a next predetermined trajectory for the selected object of step S5400 of FIG. 12. Beginning in step S5400, control continues to step S5410, where the actual current status of the selected object is determined. Then, in step S5420, all multiple predetermined trajectory envelopes of the selected object are referenced.

Next, in step S5430, the determined actual current status is compared to the referenced multiple predetermined trajectory envelopes of the selected object. Based on this comparison, the predetermined trajectory whose envelope contains the actual current status of the selected object is selected as the next predetermined trajectory for the selected object in step S5440.

For example, actual current status of the selected object could be at a location between the trajectory boundary 4020 and the nominal trajectory 4100 (with envelope 4025). In such a situation, the predetermined nominal trajectory whose envelope contains the object's location would be nominal trajectory 4100. Thus, the nominal trajectory 4100 would be selected in step S5440 as the next predetermined trajectory.

In an alternative example, the actual current status of the selected object could be at a location in the trajectory space between the trajectory boundary 4050 and the nominal trajectory 4400 (with envelope 4055). In such a situation, the predetermined nominal trajectory whose envelope contains the object's location in the trajectory space would be the nominal trajectory 4400. Thus, the nominal trajectory 4400 would be selected in step S5440.

In the above exemplary embodiment, in step S5440, the next predetermined trajectory is selected solely on the basis of being closest to the actual current status of the selected object. However, in an alternative exemplary embodiment, other factors can additionally be used to select the predetermined trajectory. Specifically, proximity to the trajectory originally selected in step S5200 can also be taken into account.

This alternative exemplary embodiment provides a more gradual change in trajectories. Thus, the alternative exemplary embodiment is less disruptive to the system level control than the exemplary embodiment discussed above.

For example, the predetermined nominal trajectory that is closest to the actual current status of the selected object, while also being adjacent to the previous nominal trajectory selected in step S5200, can be selected in step S5440. As discussed in the above example, the nominal trajectory 4000 can be the selected predetermined trajectory in step S5200. For example, the referenced actual current status of the selected object could be at a location in the trajectory space between the trajectory boundary 4050 and the nominal trajectory 4400. In such a situation, the predetermined nominal trajectory that is closest to the actual current status of the selected object, while also being adjacent to the previous nominal trajectory selected in step S5200, would be the nominal trajectory 4100.

In another exemplary embodiment, collision among multiple objects can be taken into account. Specifically, collisions can be avoided by comparing a current trajectory region of an object with the collision avoidance regions of the preceding and succeeding objects traveling along the path 240. This comparison can be based on collision avoidance criteria, such as minimum distance between two sheets.

The relationship between the current trajectory envelope of a first object and the collision avoidance region of a second immediately succeeding object can be represented as n number of tuples i,j, wherein i represents the first object's trajectory envelope and j represents the second immediately succeeding object's trajectory envelope. (Here, the n envelopes of an object are labeled from 1 through n starting from the left). If the first object is disposed in trajectory envelope i, then the second immediately succeeding object has to be disposed in trajectory envelope k, wherein $k \geqq j$. Conversely, if the second object is disposed in trajectory envelope j, then a first immediately preceding object has to be disposed in trajectory envelope k, wherein $k \leqq i$. These tuples can be collectively referred to as a collision avoidance table.

The trajectory envelope that the first object is disposed in can be the first object's nominal trajectory which satisfies all constraints. Whenever that nominal trajectory is switched to another reference trajectory, the preceding and succeeding object's reference trajectories are checked, and new reference trajectories are chosen as necessary.

If i=j for all tuples i,j in the collision avoidance table, then the reference trajectories for all of the objects are changed together, i.e., all objects in a sequence will be sped up or delayed in sync. Alternatively, if i>j for all tuples (except if i=1 or j=n for n envelopes), then only a subset of the reference trajectories will need to be changed. The relationship between reference trajectories of a first object and collision avoidance regions of a second object are explained in further detail below with reference to FIG. 14.

Figure 14:
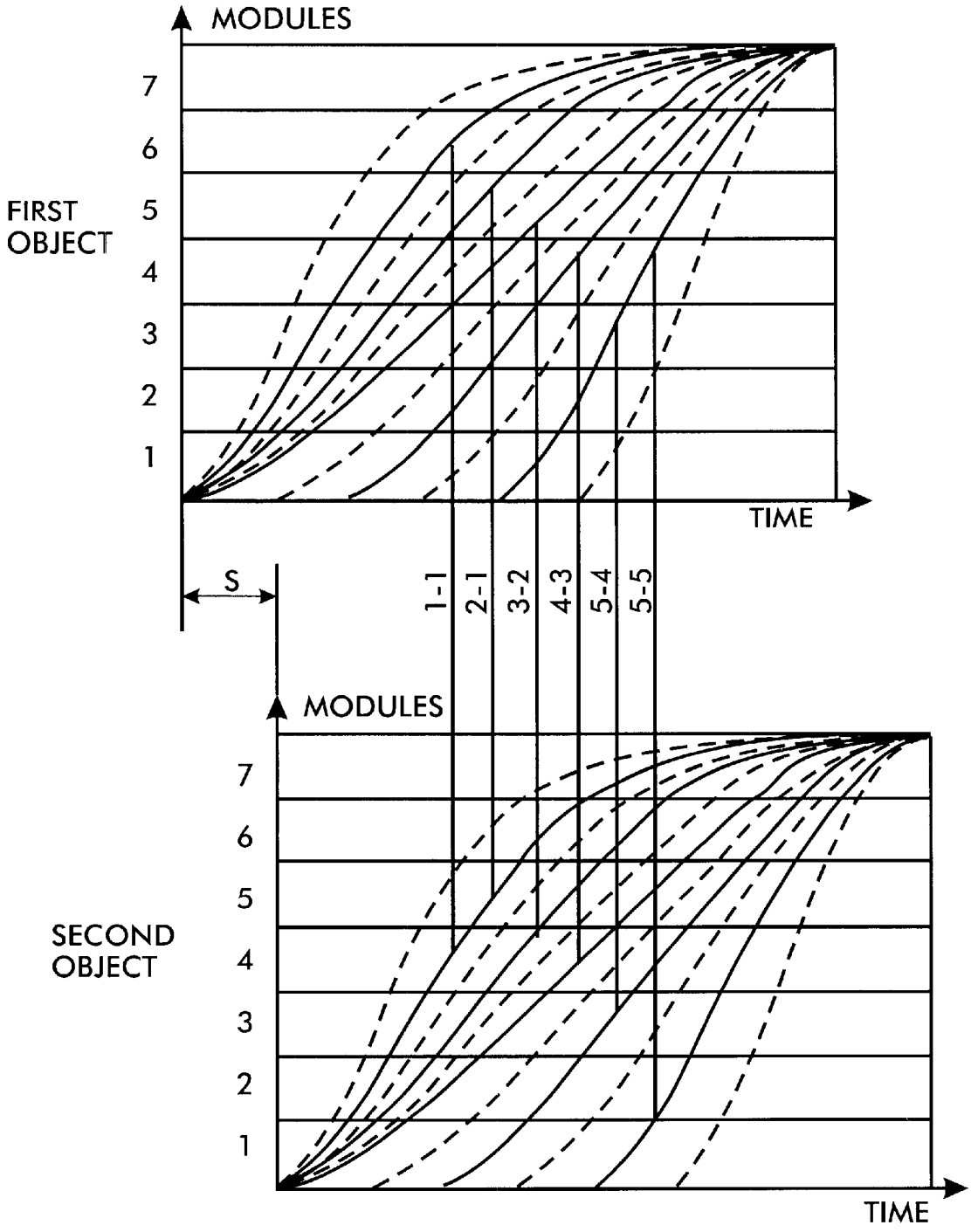
FIG. 14 is a graph showing the relationship of multiple trajectories and trajectory envelopes between multiple objects.

FIG. 14 is a graph showing the relationship of multiple trajectories and trajectory envelopes between multiple objects. Specifically, the trajectories and trajectory envelopes of a second object are shown as being shifted from the trajectories and trajectory envelopes of a first object by a distance s.

In FIG. 14, the solid lines of each object's graph represent different trajectories, and the dashed lines represent the trajectory envelopes surrounding each of these trajectories. The trajectory that is furthest to the left in each object's graph can be represented as 1, and the other trajectories can be represented as 2, 3, 4 and 5, respectively, from left to right.

Vertical lines connect trajectories among the objects to indicate collision avoidance regions, i.e., the tuples in the collision avoidance table. For example, the vertical line referenced as 1-1 connects trajectory 1 of the first object and trajectory 1 of the second object at the same time in time space. If the second object follows the trajectory indicated by vertical line 1-1 or a lower trajectory on the graph, then the second object will not collide with the first object following trajectory 1.

Similarly, vertical line 2-1 connects trajectory 2 of the first object and trajectory 1 of the second object. If the second object follows the trajectory indicated by vertical line 2-1 or a lower trajectory shown on the graph, then the second object will not collide with the first object traveling along trajectory 2.

Vertical lines 1-1 and 2-1 are discussed above in terms of determining a collision envelope of the second object based on the trajectory of the first object. However, the vertical lines can conversely be used to determine a collision envelope of the first object based on the trajectory of the second object. For example, if the first object follows a trajectory connected to a vertical line or a higher trajectory, then the first object will not collide with the second object following a trajectory connected to that vertical line.

Figure 15:
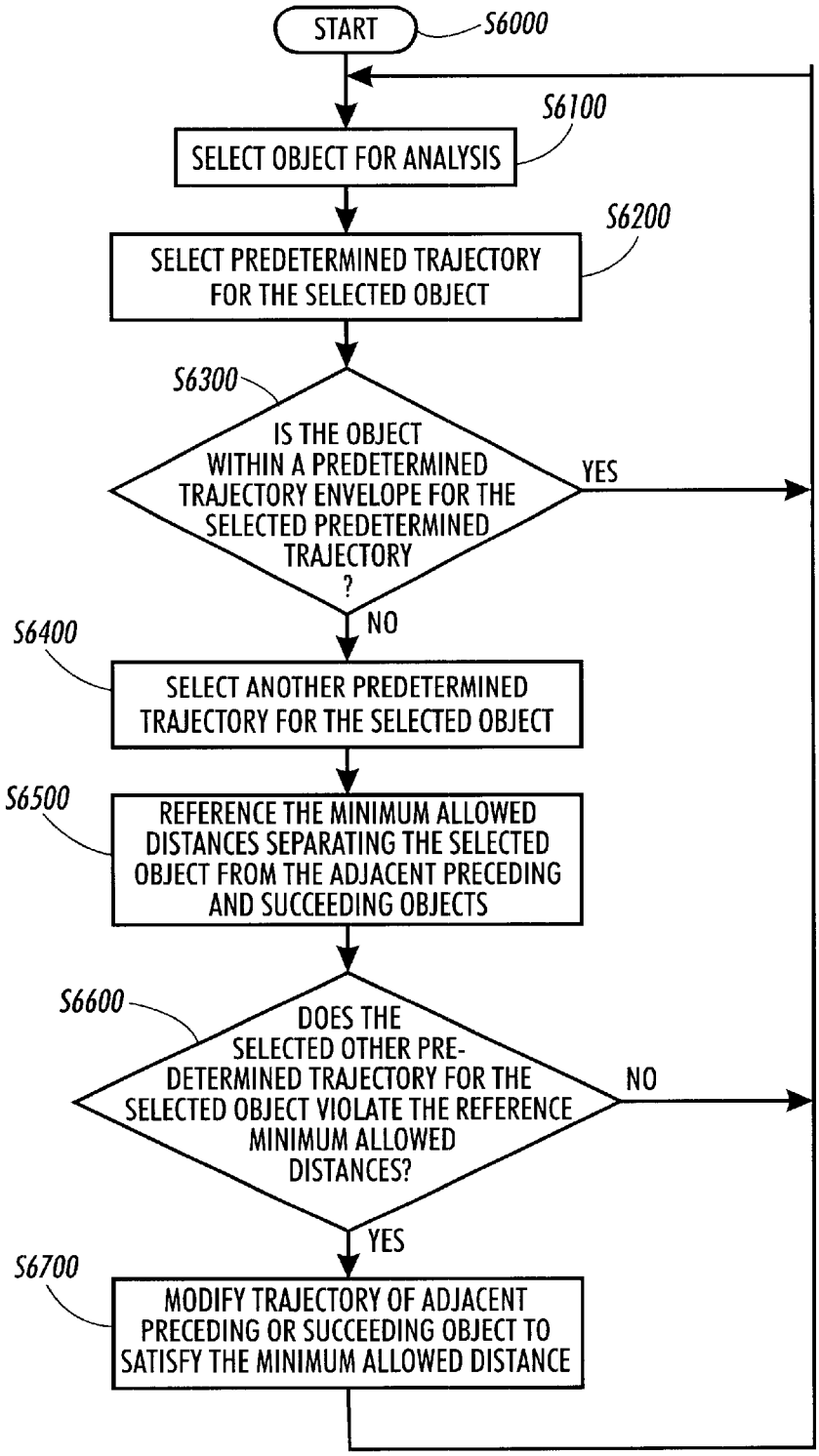
FIG. 15 is a flowchart outlining one exemplary embodiment of a method for using predetermined trajectories and trajectory envelopes for each object in system level control of a multi-level modular object handling system which also takes collision avoidance among multiple objects into account.

FIG. 15 is a flowchart outlining one exemplary embodiment of a method for using predetermined trajectories and trajectory envelopes for each object in system level control of a multi-level modular object handling system which also takes collision avoidance among multiple objects into account. It should be appreciated that steps S6000–S6400 of FIG. 15 are the same as steps S5000–S5400 of FIG. 12.

Then, following the selection of a next predetermined trajectory for the selected object in step S6400, control continues to step S6500, where the minimum allowed distances separating the selected object from the adjacent preceding and succeeding objects is referenced. The minimum allowed distances can be determined via a collision avoidance table based on data similar to the data represented in FIG. 14.

After the minimum allowed distances are referenced, control continues to step S6600, where a determination is made whether the selected other predetermined trajectory for the selected object violates, i.e., is less than, either of the referenced minimum allowed distances separating the selected object from the adjacent preceding and succeeding objects. If the minimum allowed distances are not violated, then control returns to step S6100, where another object is selected for analysis.

In contrast, if the selected other predetermined trajectory for the selected object violates either of the referenced minimum allowed distances separating the selected object from the adjacent preceding and succeeding objects, control continues to step S6700, where the trajectory of the adjacent preceding or succeeding object is modified to satisfy the minimum allowed distance. This modification can be accomplished by switching the trajectory of the affected object to the closest trajectory for that object relative to that object's current trajectory that is greater than the minimum allowed distance. Switching the trajectory to the closest acceptable trajectory increases the efficiency of the object handling method.

After the trajectory of the adjacent preceding or succeeding object is modified, control returns to step S6100, where another object is selected for analysis.

Other exemplary embodiments of the invention include determining the multiple trajectories, as well as the trajectory envelopes associated with each of the multiple trajectories. The trajectories and trajectory envelopes can be either manually or automatically predetermined prior to their usage in the control of a modular object handling system.

This determination can take various requirements of a trajectory envelope into account. One such requirement of a trajectory envelope is that all relevant constraints must remain satisfied as long as an object remains within that trajectory envelope.

An example of a relevant constraint that must be satisfied can be the safe distance constraint for collision avoidance between two objects. Determination of trajectories and trajectory envelopes can therefore be performed to ensure that for every trajectory envelope assigned to a first object, a trajectory envelope exists that can be assigned to a second object which satisfies the safe distance constraint. In other words, the trajectory envelopes of the objects must ensure that the safe distance constraint remains satisfied as long as the first and second objects remain within the determined trajectory envelopes.

Trajectories and trajectory envelopes can be determined based upon the safe distance constraint via the use of a collision avoidance table. The collision avoidance table can specify a trajectory region for one object and the earliest trajectory envelope for a second immediately succeeding object that satisfies the safe distance requirement. This relationship can be represented as a number of tuples i,j, wherein i represents the first object's trajectory envelope and j represents the second immediately succeeding object's trajectory envelope. The n trajectory envelopes of an object can be labeled 1 through n, from left to right. If the first object is disposed in trajectory envelope i, then the second immediately succeeding object has to be disposed in trajectory envelope k, wherein $k \geqq j$. Conversely, if the second object is disposed in trajectory envelope j, then a first immediately preceding object has to be disposed in trajectory envelope k, wherein $k \leqq i$.

The collision avoidance table can take various forms. For example, the tuples i,j can be defined in the collision avoidance table such that i=j. Thus, if there are 10 trajectory envelopes (n=10), and the first object is in trajectory envelope 7, then the following object has to be in one of trajectory envelopes 7, 8, 9 or 10 in order to satisfy the safe distance constraint. If the first object is delayed and moves into trajectory envelope 8, then the second object has to be in one of trajectory envelopes 8, 9 or 10.

Thus, when i=j, and an object is delayed, all following objects in the same trajectory envelope must be delayed immediately and together. Further, all future objects must also be delayed until a gap is defined in the object sequence.

Alternatively, the tuples i,j can be defined in the collision avoidance table such that i>j. For example, the collision avoidance table can be set such that i=j+1 for all tuples i,j. Thus, if there are 10 trajectory envelopes (n=10), there are four subsequent objects that are all in trajectory envelope 7, and the first object is delayed and moved from trajectory envelope 7 to trajectory envelope 8, then the safe distance constraint is still satisfied by all objects.

If the first object is delayed even further and moved to trajectory envelope 9, then only the second object has to be moved to trajectory envelope 8 to avoid collision. If the first object is delayed still further and moved to trajectory envelope 10, then the second object has to be moved to trajectory envelope 9 and the third object has to be moved to trajectory envelope 8.

If no further delays occur, then the fourth object as well as all following objects can remain in their originally determined and assigned trajectory envelopes. Thus, when the collision avoidance table is defined such that i>j, temporary delays only have finite and temporary effects on the sequence of objects, which can be referred to as the temporary delay rule.

As discussed above, the temporary delay rule can be used to determine trajectories and trajectory envelopes wherein i=j+1, for all tuples in the collision avoidance table. However, the trajectories and trajectory envelopes can also be determined based upon any relationship between i and j, wherein i>j, such as, for example, i=j+2.

Another requirement of a trajectory envelope to be taken into account in the determination of trajectories and trajectory envelopes is that the trajectory envelope be large enough so that the object will not leave the trajectory envelope under normal circumstances. Normal circumstances can be defined so as to take into account the structure and/or the operation of the modular object handling system. This requirement can also take into account any error associated with tracking the objects, which can be referred to as tracking error and is described in more detail below.

Still, other requirements of a trajectory envelope to be taken into account in the determination of trajectories and trajectory envelopes can be to ensure that the earliest trajectory envelope corresponds to the earliest possible trajectory, and that the latest trajectory envelope corresponds to the latest possible trajectory for an object. The earliest possible trajectory can be provided by the early control envelope, and the latest possible trajectory can be provided by the late control envelope.

Figure 16:
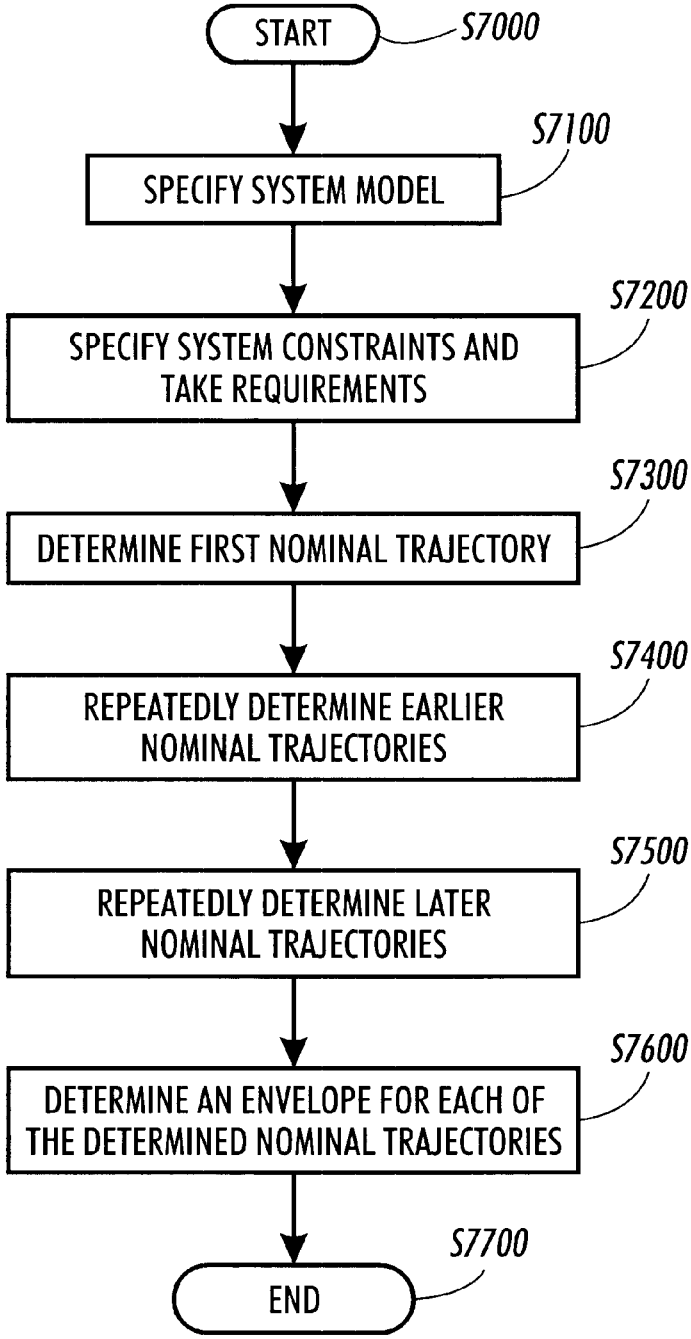
FIG. 16 is a flowchart outlining one exemplary embodiment of a method for determining trajectories and trajectory envelopes.

FIG. 16 is a flowchart outlining one exemplary embodiment of a method for determining trajectories and trajectory envelopes by explicitly representing the system constraints and task requirements while also taking the trajectory envelope requirements discussed above into account. In this exemplary embodiment, the trajectories and trajectory envelopes can be either manually or automatically predetermined.

Beginning in step S7000, control continues to step S7100, where the system model is specified. As previously discussed, specifying the system model can entail at least specifying the number of individual module actuators, the types of the specified module actuators, and the configuration of the specified module actuators. Each type of module has a distinctive set of module constraints and task requirements.

Once the system model is specified, control continues to step S7200, where the system constraints and task requirements are specified. As previously discussed, the system constraints are made up of the combined constraints of all of the module actuators. Further, each type of module actuator is subject to a distinctive set of constraints, such as maximum and minimum velocity and maximum and minimum acceleration limits, as well as constraints created by controlling multiple module actuators together and disposing the specified module actuators adjacent to each other.

Also, as previously discussed, the task requirements can additionally be described in terms of the individual module actuators. For example, accomplishing a certain task may subject a module actuator to a variety of constraints, such as, for example, target criteria, collision avoidance and velocity and acceleration limits.

Each type of the module actuators can also have a variety of general task constraints that may need to be satisfied for that type of module actuator to accomplish its designated task. For example, in accordance with general task constraints of a certain type of module actuator, an object may need to have a certain initial velocity $v_0$ and a certain ending velocity $v_n$. The certain type of module actuator may also need to operate such that the object always travels at a certain velocity v within the module actuator.

Similarly, each type of module actuator can have nominal task constraints that may need to be satisfied to meet other criteria, such as to enable the module actuator to operate at increased efficiency. For example, the nominal task constraints can include the general task constraints, and additionally a constraint that the module actuator operates such that the velocity v of the object within the module actuator is always less than or greater than a certain velocity. Satisfying this constraint may thereby enable the module actuator to operate more quickly and reliably.

As discussed above regarding the safe distance constraint, the system constraints and task requirements of a certain type of module actuator may also require that objects within the module actuator be separated by certain constraints to satisfy task requirements and/or prevent collisions with other objects. For example, the objects may need to be separated for by a period "s," and/or by a minimum gap "g."

Once the system constraints and task requirements are specified, control continues to step S7300, where a first nominal trajectory $T_r$ of an object is determined. The first nominal trajectory $T_r$ can be predetermined via a constraint solver, such as a generic constraint solver or an optimizing constraint solver, that solves the system and task constraints, such as the constraints discussed above, while minimizing associated trajectory criteria. For example, the first nominal trajectory $T_r$ can be predetermined via the constraint $t_0=0$, and minimizing the constraints $t_n-t_0$, wherein $t_0$ is the time that the object enters the first module actuator 230 and $t_n$ is the time that the object exits the last module actuator 230 on the path 240.

In determining the first nominal trajectory $T_r$, the constraints are translated to constraints on the desired trajectory, such as, for example, to constraints on the cubic splines defined by the trajectory. Constraints on entry and exit times and velocities are directly added to the cubic splines. Minimum and maximum constraints on the velocities and accelerations of entire modules can be translated to constraints on the minima and maxima of the velocity and acceleration functions defined by the cubic splines.

The set of particular task constraints depends on the trajectory's purpose. Thus, the first nominal trajectory $T_r$ may satisfy all task constraints since it constitutes the desired trajectory.

Once the first nominal trajectory is determined, control continues to step S7400 where earlier nominal trajectories are repeatedly determined. The earlier nominal trajectories can be determined, starting at the first nominal trajectory, by applying a safe object distance constraint backward, applying an expected error/deviation model, and/or solving a suitable subset of the constraints while optimizing for the earliest possible new trajectory.

Once the earlier nominal trajectories are determined, control continues to step S7500 where later nominal trajectories are repeatedly determined. The later nominal trajectories can be determined, starting at the first nominal trajectory, by applying a safe object distance constraint forward, applying an expected error/deviation model, and/or solving a suitable subset of the constraints while optimizing for the latest possible new trajectory.

In step S7400, determining an earlier nominal trajectory, which can be represented as i−1, from a nominal trajectory, which can be represented as i, in accordance with the temporary delay rule discussed above, can be performed by assigning trajectory i to a first object and trajectory i−1 to a second object. Trajectory i−1 can then be determined as early as possible under the safe distance constraint. This can be done repeatedly, i.e., trajectory i−2 is determined from trajectory i−1, and so on. Similarly, in step S7500, determining a later nominal trajectory, which can be represented as i+1, from nominal trajectory i, can be performed by assigning trajectory i+1 to a first object and trajectory i to a second object, and generating trajectories i+1 as late as possible under the safe distance constraint. This can be done repeatedly, i.e., trajectory i+2 is determined from trajectory i+1, and so on. This method can be performed to determine a minimum number of nominal trajectories that satisfy the temporary delay rule.

Once the later nominal trajectories are determined, control continues to step S7600 where an envelope is determined for each of the determined nominal trajectories. The envelopes can be determined to separate each of the determined nominal trajectories from adjoining nominal trajectories.

After the control envelopes have been delivered, control ends at step S7700.

Determining earlier and later nominal trajectories in accordance with steps S7400 and S7500, including the tracking error model and the safe object distance constraint, is explained in more detail below. In the below explanations, for trajectory i, $y_i(t)$ represents position; and $v_i(t)$ represents velocity.

Similarly, in the below explanations, for trajectory i*, which is trajectory i shifted by a constant s, i.e., the time between image transfers, $y^*_i(t)$ can represent position, wherein $y^*_i(t)=y_i(t-s)$; and $v^*_i(t)$ can represent velocity, wherein $v^*_i(t)=v_i(t-s)$.

The expected error deviation model, which can be a tracking error model, for example, defines any error involved in tracking the objects along the path. The tracking error model is described in detail below.

The tracking error model can be defined as the following sample model for the potential tracking error. However, the method in accordance with the invention includes any model that defines the error involved in tracking objects. These models can define an envelope before and after a trajectory such that, under normal circumstances, the object can be maintained within the envelope when tracking the trajectory.

In this model, $t_c$ can represent the control reaction constant (sampling time), i.e., the time within which the system controller can correct tracking errors, $d_v$ can represent the expected maximum velocity deviation, i.e., the maximum velocity-tracking error, during $t_c$, expressed as a percentage, and $y_c(t)$ can represent the error position after the maximum deviation was applied everywhere to y(t). The error position can be represented as:

$$y_c(t)=y(t-t_c)+(1\pm d_v)\times v(t-t_c)\times t_c,$$

which is the actual position plus the distance attained upon starting with the nominal velocity at $t-t_c$ and applied maximum deviation. Since this is the maximum deviation, a position error for all times t can be represented as:

$$e^{\pm}(t)=y_c(t)-y(t)=\pm d_v\times v(t-t_c)\times t_c, \text{ wherein}$$

$e^*(t)$ and $e^*(t)$ are the error trajectory envelopes to the left and right of the trajectory.

The safe distance constraint defines a minimum distance between objects moving along the path to ensure that the objects do not collide with each other. The safe distance constraint is described in detail below.

The safe distance constraint can include a requirement that the leading edges of any two objects must always be separated by at least $g_{min}$, which can operate as a constraint, on the path. The maximum of all minimum accelerations of all modules can be represented as $a_{min}$.

The relative distance and velocity between two sheets on trajectories i and (i−1)* can then be defined as:

$$g_y(t)=y_i(t)-y^*_{i-1}(t);$$

and $$g_v(t)=v_i(t)-v^*_{i-1}(t)$$

For all $t_0$, when $g_v(t_0)\geqq 0$, then maintain $g_y(t_0)\geqq g_{min}$. For all $t_0$, when $g_v(t_0)<0$ (assume $v_1(t)$ constant for $t>t_0$, in particular if $v_i(t_0)=0$ and $g_v(t_0)=-v^*_{i-1}(t_0)$), then apply maximum deceleration $a_{ca}$ to second sheet (e.g., $a_{ca}=a_{min}$), which will slow the second sheet to $v^*_{i-1}(t_1)=v_i(t_1)=v_i(t_0)$ at time $t_1=t_0+g_v(t_0)/a_{ac}$ (because $g_v(t_1)=0$), such that the relative distance at time $t_1$ , will be as follows:

$$\begin{aligned}
g_y(t_1) &= g_y(t_0)+\int_{t_0}^{t_1} g_v(t)\,dt \\
&= g_y(t_0)+\int_{t_0}^{t_1}(g_v(t_0)-a_{ca}(t-t_0))\,dt \\
&= g_y(t_0)-\frac{1}{2a_{ca}}(g_v(t_0)-a_{ca}(t_1-t_0))^2+\frac{1}{2a_{ca}}(g_v(t_0)-a_{ca}(t_0-t_0))^2 \\
&= g_y(t_0)-\frac{1}{2a_{ca}}(g_v(t_0)-a_{ca}(t_1-t_0))^2+\frac{1}{2a_{ca}}g_v(t_0)^2 \\
&= g_y(t_0)-\frac{1}{2a_{ca}}(g_v(t_0)-g_v(t_0))^2+\frac{1}{2a_{ca}}g_v(t_0)^2 \\
&= g_y(t_0)+\frac{1}{2}\frac{g_v(t_0)^2}{a_{ca}}
\end{aligned}$$

This representation must be $\geqq g_{min}$, i.e., maintain the safe-distance constraint:

$$g_y(t_0)+\frac{1}{2}\frac{g_v(t_0)^2}{a_{ca}}\geq g_{\min}.$$

Figure 17:
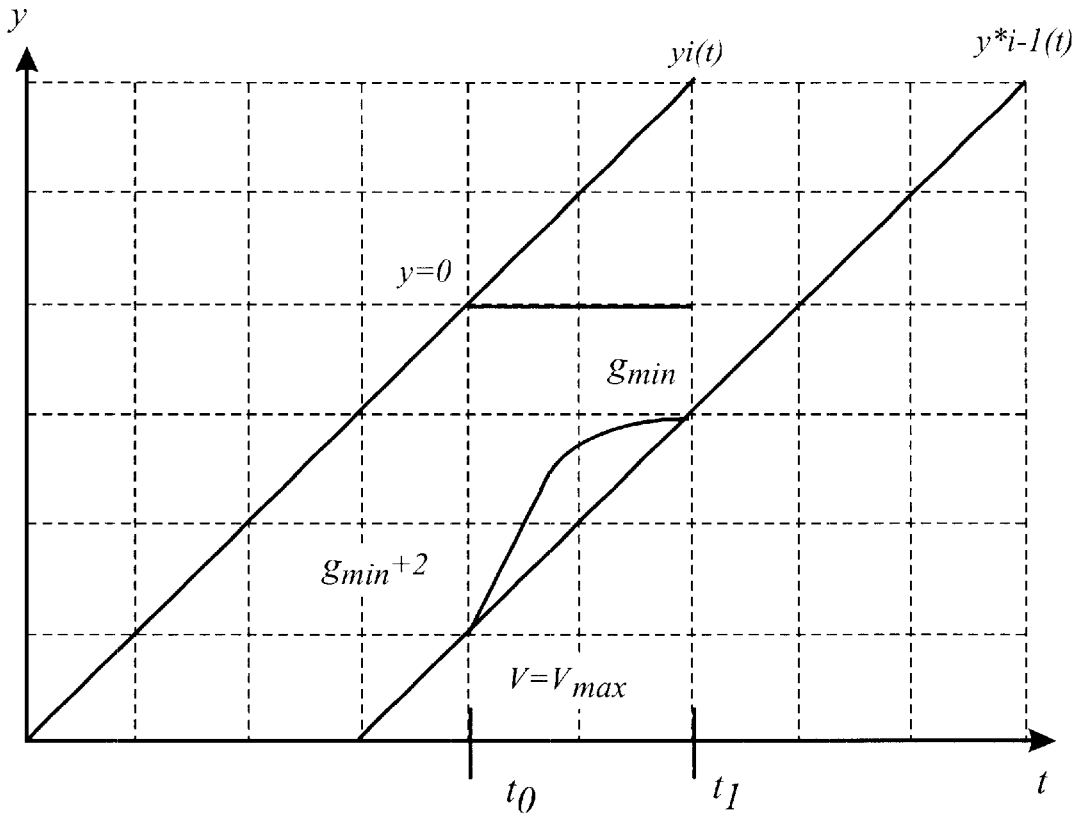
FIG. 17 is a graph that shows the safe distance constraint.

FIG. 17 is a graph that shows the safe distance constraint discussed above. Specifically, FIG. 17 shows two trajectories i and (i−1)*, where the first object stops at time $t_0$ ($v_1(t_0)=0$), and the second object travels at maximum velocity and is decelerated with $a_{ca}$ at that time ($v^*_{i-1}(t_0)=v_{max}$. In FIG. 17, $v_{max}=2$, $a_{ca}=-1$, $g_{min}=1$, i.e., the desired gap $g_y(t_0)$ is 3.

An exemplary embodiment of the determination of earlier nominal trajectories of step S7400 of FIG. 16 is described in detail below. In describing this determination, the relative distance and velocity between two objects on trajectories i and (i−1)* can be represented as follows:

$$g_y(t)=y_i(t)-y^*_{i-1}(t);$$

and $$g_v(t)=v_i(t)-v^*_{i-1}(t).$$

To generate a trajectory i−1 from trajectory i, the earliest possible trajectory $y_{i-1}(t)$ can be determined such that the shifted version of this trajectory satisfies the safe-distance constraint to the existing trajectory. For example, for every point with time t on trajectory i:

$v_1(t)=0$ and $v^*_{i-1}(t)=v_{max}$ (worst-case scenario for both objects), i.e., $g_v(t)=-v_{max}$;

$$g_y(t_0)+\frac{1}{2}\frac{g_v(t_0)^2}{a_{ca}}\geq g_{\min}(\text{cf. above}),$$

$$\text{i.e., } g_y(t)+\frac{1}{2}\frac{v_{\max}^2}{a_{ca}}\geq g_{\min},$$

$$\text{i.e., } y_{i-1}(t-s)\leq y_i(t)-\left(g_{\min}-\frac{1}{2}\frac{v_{\max}^2}{a_{ca}}\right).$$

The above representation is the constraint to be satisfied, in addition to the normal control criteria (minimum and maximum velocities, target velocity, etc.), when generating trajectory i−1.

In order to account and allow for expected errors around trajectories, an error envelope can be assumed for trajectory i with gap $e^+_i(t)$ below $y_i(t)$, and an error envelope can be assumed for trajectory i−1 with gap $e^-_{i-1}(t)$ above $y_{i-1}(t)$ (cf. tracking error model above). The error envelopes, instead of the trajectories, are required to satisfy the safe-distance constraint. For example, set:

$$y_{i-1}(t-s)\leq y_i(t)-e_i^+(t)-\left(g_{\min}-\frac{1}{2}\frac{v_{\max}^2}{a_{ca}}\right)-e_{i-1}^-(t-s).$$

Figure 18:
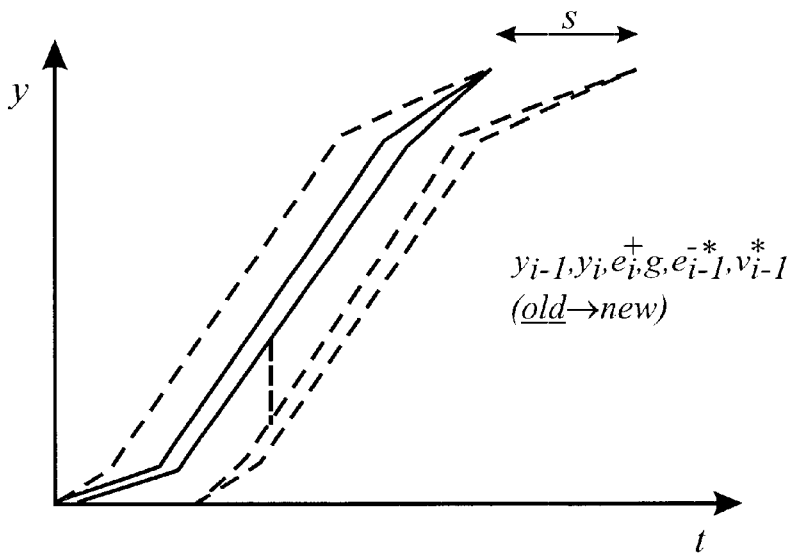
FIG. 18 is a graph that shows trajectories determined in accordance with the backward trajectory determination of step S7400 of FIG. 16.

FIG. 18 is a graph that shows trajectories determined in accordance with the backward trajectory determination of the exemplary embodiment of step S7400 discussed above. The labels of FIG. 18, from left to right, are for the trajectories, from left to right. The solid lines indicate trajectories that are started with, and the dashed lines indicate trajectories that are determined from the solid line trajectories.

Further, an earliest possible trajectory under a set of constraints can be generated as previously discussed. Also, any trajectory between i−1 and i can be used as boundary between the trajectories i−1 and i, under the constraint that it should be outside of the error envelopes. An exemplary embodiment to accomplish this is to use a trajectory midway between i−1 and i. Alternately, it is also possible to use a linear trajectory for faster online checks, even if the nominal trajectories are represented as splines.

An exemplary embodiment of the determination of later nominal trajectories of step S7500 of FIG. 16 is described in detail below. In describing this determination, the relative distance and velocity between two objects on trajectories i+1 and i* can be represented as follows:

$$g_y(t)=y_{i-1}(t)-y^*_1(t);$$

and $$g_v(t)=v_{i-1}(t)-v^*_i(t).$$

To generate a trajectory i+1 from trajectory i, the latest possible trajectory $y_i_1$ (t) can be determined such that the shifted version of i satisfies the safe distance constraint to the new trajectory. For example, for every point with time t on trajectory i:

$$g_y(t) \text{ as above, i.e., } y_{i+1}(t+s) \geq y_i(t) + \left(g_{\min} - \frac{1}{2}\frac{v_{\max}^2}{a_{ca}}\right).$$

The above representation is the constraint to be satisfied when generating trajectory i+1. Again, this constraint is in addition to the normal control criteria, except that the start time is not constrained (i.e., does not have to be equal to the start time of trajectory i).

In order to account and allow for expected errors around trajectories, an error envelope can be assumed for trajectory i+1 with gap $e^+_{i-1}(t)$ below $y_{i+1}(t)$, and an error envelope for trajectory i with gap $e^-_i(t)$ above $y_i(t)$. The error envelopes, instead of the trajectories, are required to satisfy the safe-distance constraint. For example, set:

$$y_{i+1}(t+s) \geq y_i(t) + e^+_{i+1}(t+s) + \left(g_{\min} - \frac{1}{2}\frac{v_{\max}^2}{a_{ca}}\right) + e^-_1(t).$$

Figure 19:
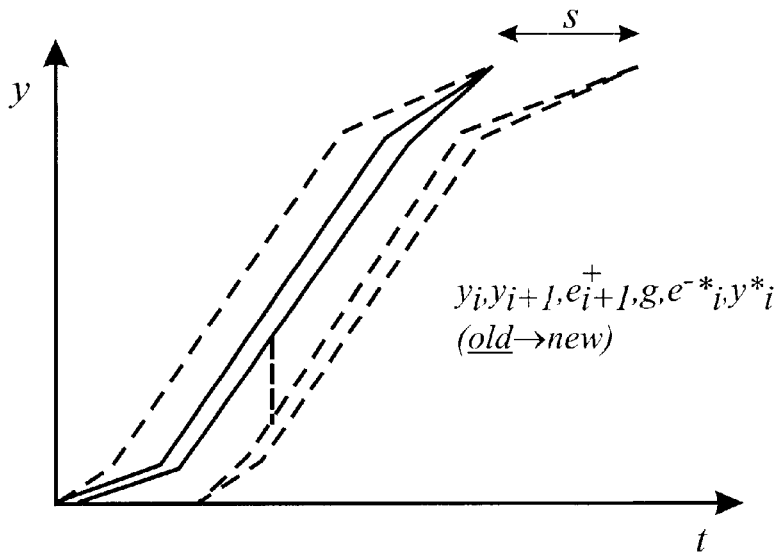
FIG. 19 is a graph that shows trajectories determined in accordance with the forward trajectory determination of step S7500 of FIG. 16.

FIG. 19 is a graph that shows trajectories determined in accordance with the forward trajectory determination of the exemplary embodiment of step S7500 discussed above. The labels of FIG. 19, from left to right, are for the trajectories, from left to right. The solid lines indicate trajectories that are started with, and the dashed lines indicate trajectories that are determined from the solid line trajectories.

Further, a latest possible trajectory under a set of constraints can be generated as previously discussed. Additionally, any trajectory between i and i+1 can be used as a boundary between the regions i and i+1, under the constraint that it should be outside of the error envelopes. The methods and applications discussed above regarding step S7400 can also be applied here.

The multilevel modular object handling systems discussed above can detect the actual current position of each object in accordance with any conceivable method or apparatus. For example, the actual position may be obtained via any type of detecting sensor. The actual position may also be estimated by a determination observer, such as a Luenberger observer, or alternatively a stochastic observer, such as a Kalman filter. The actual position may also be determined via a combination of actual sensing and estimation.

The module controllers 220 do not have to be completely subservient to the trajectories provided by the system controller 210. For example, module controllers 220 can be kept abreast of how close an object gets to one of the boundaries of a trajectory envelope and use that information to improve its efforts in achieving a task.

The trajectories and trajectory envelopes discussed above are discussed in terms of position, velocity and/or acceleration as functions of time. However, the trajectories and trajectory envelopes are not limited to these expressions, and can include any data relating to an object.

In the various exemplary embodiments discussed in detail above, the modular object handling systems use a two-layered hierarchical architecture, i.e., a single system controller and multiple module controllers. However, the modular object handling systems and methods according to this invention can use any number of layers of control, such as, for example, at least one intermediate control layer between the system controller and the module controllers. Moreover, the modular object handling systems and methods according to this invention can include multiple system controllers.

The modular object handling systems and methods according to this invention can include both predetermined collision and control envelopes. Alternatively, the modular object handling systems and methods according to this invention can use only predetermined collision envelopes or only predetermined control envelopes. Further, the predetermined trajectories and trajectory envelopes do not have to relate to collision and control borders and regions. Instead, the trajectories and trajectory envelopes can relate to any task or constraint. For example, multiple trajectory envelopes can be provided for different object sizes.

Also, in the various exemplary embodiments discussed in detail above, the modular object handling systems are described in terms of an object entering, exiting, or being within module actuators 230. However, the systems, trajectories and trajectory envelopes can also be described in terms of the object entering, exiting, or being within modules associated with each of the module actuators 230. Such modules could further be described as regions of the path 240 that are under the control of the module actuators 230.

The various controllers of the each of the multi-level modular object handling systems described above can be implemented using a programmed general purpose computer. However, the various controllers of the each of the multi-level modular object handling systems described above can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 5–7 and 9, can be used to implement the various controllers of the each of the multi-level modular object handling systems described above.

The communication links 250 can be any known or later developed device or system for connecting the system controller 210, module controllers 220, and the module actuators 230, including a direct cable connection, a connection over a wide area network or a local area network, a connection over an intranet, a connection over the Internet, or a connection over any other distributed processing network or system. In general, the communication links 250 can be any known or later developed connection system or structure usable to connect the system controller 210, module controllers 220, and the module actuators 230.

While the systems and methods of this invention have been described in conjunction with the specific embodiments outlined above, it is evident that many alternatives, modifications and variations will be apparent to those skilled in the art. Accordingly, the exemplary embodiments of the systems and methods of this invention, as set forth above, are intended to be illustrative, not limiting. Various changes may be made without departing from the spirit and scope of the invention.

What is claimed is:

1. A method of determining trajectories for object handling, comprising:

specifying a system model of an object handling apparatus;

specifying at least one of explicitly represented system constraints and explicitly represented task requirements of the object handling apparatus;

determining a first specified trajectory in a trajectory space for a specified object to accomplish a system function based on the specified system model and the specified ones of the explicitly represented system constraints and task requirements; and determining at least one earlier trajectory for the specified object that is earlier in the trajectory space than the first specified trajectory.

2. The method according to claim 1, further including determining at least one later trajectory for the specified object that is later in the trajectory space than the first specified trajectory.

3. The method according to claim 2, further including determining a trajectory envelope for each of the first specified trajectory, the at least one earlier trajectory, and the at least one later trajectory.

4. The method according to claim 3, wherein determining a trajectory envelope includes determining a trajectory envelope defined by border trajectories that separate adjacent trajectories.

5. The method according to claim 2, wherein the first specified trajectory, the at least one earlier trajectory and the at least one later trajectory each constitute a nominal trajectory.

6. The method according to claim 1, wherein determining at least one earlier trajectory includes determining multiple earlier trajectories that are earlier in the trajectory space than the first specified trajectory starting from the first specified trajectory and proceeding backward.

7. The method according to claim 2, wherein determining at least one later trajectory includes determining multiple later trajectories that are later in the trajectory space than the first specified trajectory, starting from the first specified trajectory and proceeding forward.

8. The method according to claim 1, wherein determining at least one earlier trajectory includes determining at least one earlier trajectory by applying a safe distance constraint backward.

9. The method according to claim 8, wherein determining at least one earlier trajectory includes determining at least one earlier trajectory by applying an expected error/deviation model.

10. The method according to claim 9, wherein applying an expected error/deviation model includes applying a tracking error model that defines deviation in tracking objects moving along a path of the object handling apparatus.

11. The method according to claim 10, wherein determining at least one earlier trajectory includes determining at least one earlier trajectory by solving constraints while optimizing for an earliest possible new trajectory.

12. The method according to claim 2, wherein determining at least one later trajectory includes determining at least one later trajectory by applying a safe distance constraint forward.

13. The method according to claim 12, wherein determining at least one later trajectory includes determining at least one later trajectory by applying an expected error/deviation model.

14. The method according to claim 13, wherein applying an expected error/deviation model includes applying a tracking error model that defines deviation in tracking objects moving along a path of the object handling apparatus.

15. The method according to claim 14, wherein determining at least one later trajectory includes determining at least one later trajectory by solving constraints while optimizing for a latest possible new trajectory.

16. An apparatus that determines trajectories of objects that are movable along a path of an object handling system, the apparatus comprising:

a device that determines a first specified trajectory in a trajectory space for a specified object to accomplish a system function of the object handling system and at least one of at least one specified explicitly represented constraint of the object handling system and at least one specified explicitly represented task requirement of the object handling system, the device also determining at least one later trajectory for the specified object that is later in the trajectory space than the first specified trajectory.

17. The apparatus according to claim 16, wherein the device determines at least one earlier trajectory for the specified object that is earlier in the trajectory space than the first specified trajectory.

18. The apparatus according to claim 17, wherein the device determines a trajectory envelope for each of the first specified trajectory, the at least one earlier trajectory, and the at least one later trajectory.

19. The apparatus according to claim 18, wherein each trajectory envelope determined by the device is defined by border trajectories that separate adjacent trajectories.

20. The apparatus according to claim 17, wherein the first specified trajectory, the at least one earlier trajectory and the at least one later trajectory each constitute a nominal trajectory.

21. The apparatus according to claim 17, wherein the device determines multiple earlier trajectories that are earlier in the trajectory space than the first specified trajectory starting from the first specified trajectory and proceeding backward.

22. The apparatus according to claim 16, wherein the device determines multiple later trajectories that are later in the trajectory space than that first specified trajectory, starting from the first specified trajectory and proceeding forward.

23. The apparatus according to claim 17, wherein the device determines at least one earlier trajectory by applying a safe distance constraint backward.

24. The apparatus according to claim 23, wherein the device determines at least one earlier trajectory by applying an expected error/deviation model.

25. The apparatus according to claim 24, wherein the device applies an expected error/deviation model by applying a tracking error model that defines deviation in tracking objects moving along a path of the object handling system.

26. The apparatus according to claim 25, wherein the device determines at least one earlier trajectory by solving constraints while optimizing for an earliest possible new trajectory.

27. The apparatus according to claim 16, wherein the device determines at least one later trajectory by applying a safe distance constraint forward.

28. The apparatus according to claim 27, wherein the device determines at least one later trajectory by applying an expected error/deviation model.

29. The apparatus according to claim 28, wherein the device applies an expected error/deviation model by applying a tracking error model that defines deviation in tracking objects moving along a path of the object handling system.

30. The apparatus according to claim 29, wherein the device determines at least one later trajectory by solving constraints while optimizing for a latest possible new trajectory.

* * * * *